US010506670B2

(12) United States Patent
Bohrer

(10) Patent No.: US 10,506,670 B2
(45) Date of Patent: Dec. 10, 2019

(54) MICROWAVE ENERGY INTERACTIVE POUCHES

(75) Inventor: Timothy H. Bohrer, Chicago, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 1247 days.

(21) Appl. No.: 13/454,511

(22) Filed: Apr. 24, 2012

(65) Prior Publication Data

US 2012/0279956 A1 Nov. 8, 2012

Related U.S. Application Data

(60) Provisional application No. 61/478,585, filed on Apr. 25, 2011.

(51) Int. Cl.
*H05B 6/80* (2006.01)
*H05B 6/64* (2006.01)

(52) U.S. Cl.
CPC ..... *H05B 6/6408* (2013.01)

(58) Field of Classification Search
CPC .. H05B 6/6408; H05B 6/6494; B65D 75/008; B65D 2581/3472; B65D 2581/3477; B65D 2581/3494; B65D 75/5805; B65D 2581/3474
USPC ..... 219/730
See application file for complete search history.

(56) References Cited

U.S. PATENT DOCUMENTS 4,283,427 A 8/1981 Winters et al.
4,345,133 A 8/1982 Cherney et al.
4,626,641 A * 12/1986 Brown ..... B65D 81/3453 219/729
4,703,149 A 10/1987 Sugisawa et al.
4,890,439 A 1/1990 Smart et al.
4,943,456 A 7/1990 Pollart et al.
5,002,826 A 3/1991 Pollart et al.
5,003,142 A 3/1991 Fuller
5,118,747 A 6/1992 Pollart et al.
5,177,332 A 1/1993 Fong
5,180,894 A 1/1993 Quick et al.
5,410,135 A 4/1995 Pollart et al.
(Continued)

FOREIGN PATENT DOCUMENTS

GB 2 202 118 A 9/1988
GB 2 252 482 A 8/1992
(Continued)

OTHER PUBLICATIONS

International Search Report and Written Opinion for PCT/US2012/034766 dated Oct. 30, 2012.
(Continued)

*Primary Examiner* — Dana Ross
*Assistant Examiner* — Kuangyue Chen
(74) *Attorney, Agent, or Firm* — Womble Bond Dickinson (US) LLP

(57) ABSTRACT

A flexible microwave heating package for food includes a first panel and a second panel joined to one another in a facing relationship, and a third panel joined to the first panel and the second panel. The first panel and second panel define walls of the package and the third panel defines a base of the package. The first panel and second panel may each include microwave energy interactive material operative for reflecting at least a portion of incident microwave energy.

32 Claims, 8 Drawing Sheets

(56) References Cited

U.S. PATENT DOCUMENTS

| | | | | |
|---|---|---|---|---|
| 5,412,187 | A | 5/1995 | Walters et al. | |
| 5,416,304 | A | 5/1995 | De La Cruz et al. | |
| 5,464,969 | A | 11/1995 | Miller | |
| 5,489,766 | A | 2/1996 | Walters et al. | |
| 5,530,231 | A | 6/1996 | Walters et al. | |
| 5,773,801 | A * | 6/1998 | Blamer | B65D 81/3469 219/727 |
| 6,060,096 | A | 5/2000 | Hanson et al. | |
| 6,204,492 | B1 | 3/2001 | Zeng et al. | |
| 6,222,168 | B1 | 4/2001 | Witonsky et al. | |
| 6,433,322 | B2 | 8/2002 | Zeng et al. | |
| 6,552,315 | B2 | 4/2003 | Zeng et al. | |
| 6,677,563 | B2 | 1/2004 | Lai | |
| 7,019,271 | B2 | 3/2006 | Wnek et al. | |
| 7,070,841 | B2 | 7/2006 | Benim et al. | |
| 7,081,286 | B2 | 7/2006 | Benim et al. | |
| 7,170,040 | B1 | 1/2007 | Benim et al. | |
| 7,351,942 | B2 | 4/2008 | Wnek et al. | |
| 7,514,659 | B2 * | 4/2009 | Lafferty | 219/730 |
| 8,263,918 | B2 * | 9/2012 | Hach | 219/730 |
| 2002/0100755 | A1 * | 8/2002 | Peterson | B65D 75/522 219/727 |
| 2003/0049354 | A1 | 3/2003 | Murray | |
| 2004/0118839 | A1 | 6/2004 | Hughes et al. | |
| 2005/0079251 | A1 | 4/2005 | Bell | |
| 2005/0152624 | A1 | 7/2005 | Versluys | |
| 2006/0127549 | A1 | 6/2006 | Murray | |
| 2006/0196784 | A1 | 9/2006 | Murray | |
| 2007/0284369 | A1 | 12/2007 | Murray | |
| 2008/0006623 | A1 * | 1/2008 | Cole et al. | 219/730 |
| 2008/0006632 | A1 | 1/2008 | Vovan | |
| 2008/0035634 | A1 | 2/2008 | Zeng et al. | |
| 2008/0078759 | A1 | 4/2008 | Wnek et al. | |
| 2008/0087664 | A1 * | 4/2008 | Robison et al. | 219/727 |
| 2008/0135544 | A1 * | 6/2008 | Lafferty et al. | 219/730 |
| 2008/0138474 | A1 | 6/2008 | Murray | |
| 2008/0276645 | A1 | 11/2008 | Murray | |
| 2009/0175563 | A1 | 7/2009 | Weaver | |
| 2009/0181132 | A1 | 7/2009 | Hughes et al. | |
| 2009/0208147 | A1 | 8/2009 | Steele | |
| 2009/0223951 | A1 | 9/2009 | Lai et al. | |
| 2009/0232424 | A1 | 9/2009 | Bierschenk | |
| 2009/0272736 | A1 * | 11/2009 | Cole | 219/730 |
| 2009/0294439 | A1 | 12/2009 | Lai et al. | |
| 2010/0012651 | A1 | 1/2010 | Dorsey | |
| 2010/0055429 | A1 | 3/2010 | Lee et al. | |
| 2010/0068353 | A1 | 3/2010 | Gorman et al. | |
| 2010/0213192 | A1 | 8/2010 | Middleton et al. | |
| 2012/0012578 | A1 | 1/2012 | Hach | |

FOREIGN PATENT DOCUMENTS

| | | | |
|---|---|---|---|
| JP | 2-114680 | | 9/1990 |
| JP | 2000-007053 | | 1/2000 |
| JP | 2002193350 | A | 7/2002 |
| JP | 2006-021510 | | 1/2006 |
| JP | 2006-111351 | | 4/2006 |
| JP | 2010-516575 | | 5/2010 |
| KR | 1998-057590 | | 10/1998 |
| WO | WO 2007/113545 | A1 | 10/2007 |
| WO | WO 2007/127371 | A2 | 11/2007 |
| WO | WO 2007/146650 | A2 | 12/2007 |
| WO | WO 2008/091760 | A1 | 7/2008 |
| WO | WO 2009023286 | A1 * | 2/2009 ..... B65D 5/0209 |
| WO | WO 2009/111373 | A2 | 9/2009 |

OTHER PUBLICATIONS

Mondi, "Zip&Valve Pouch—innovative food packaging solution for microwaveable cooking", www.mondigroup.com/products/desktopdefault.aspx/tabid-1478, © 2012, printed Nov. 20, 2012 (1 page).

International Search Report—PCT/US2009/035655, dated Mar. 2, 2009, Graphic Packaging International, Inc.

Written Opinion—PCT/US2009/035655, dated Mar. 2, 2009, Graphic Packaging International, Inc.

Supplementary European Search Report for EP 12 77 6060 dated Oct. 6, 2014.

Notification of Reason for Refusal for JP 2014-508480 dated Dec. 25, 2015, with English translation.

Notification of Reason for Refusal for JP 2014-508480 dated Mar. 12, 2015, with English translation.

Office Action for CA 2,831,953 dated Aug. 19, 2016.

* cited by examiner

MICROWAVE ENERGY INTERACTIVE POUCHES

CROSS-REFERENCE TO RELATED APPLICATION

This application claims the benefit of U.S. Provisional Application No. 61/478,585, filed Apr. 25, 2011, which is incorporated by reference herein in its entirety.

BACKGROUND

Flexible retort pouches are gaining popularity around the world as offering greater shelf appeal, greater convenience, and using less material than traditional retort packages, such as metal cans or high barrier rigid plastic containers.

Retort pouches were initially developed as a replacement for metal cans used for military field rations. They have typically been constructed from a flexible multi-layer foil-plastic laminate that is able to withstand post-fill thermal processing for sterilization and provide long shelf life and high durability. However, such packages are generally not suitable for use in a microwave due to the presence of the continuous foil layer, which reflects microwave energy.

More recently, retort pouches that can be used in a microwave oven have been introduced into the marketplace. For example, one package comprises a stand up pouch for rice that uses a non-foil barrier material that is generally transparent to microwave energy. While this type of microwave energy inactive or "passive" package may be acceptable for certain types of comestibles (i.e., food), for example, rice, such packages may have limited utility for other food items because the irregular geometry of the package and the food therein may lead to uneven heating, particularly when the package is a stand up pouch that is heated in the upright position. Additionally, such packages are often too hot to handle after microwave heating. In some commercial embodiments of the above-mentioned package for rice, contoured or wider side seal areas are included near the top of the pouch in an attempt to provide a cooler area for consumers to grasp the hot package after microwave heating.

Thus, there is a need for microwave interactive retort packages that are capable of providing even heating of the food item or items in a microwave oven.

SUMMARY

This disclosure is directed generally to microwave heating packages. In one example, the package may comprise a stand up pouch. However, the microwave heating package may have any suitable configuration and/or geometry.

The package may be made from combinations of various flexible materials, for example, thin polymer films, including monolayer and coextruded films, solution and vapor deposition coated films, mono and biaxially oriented films, light weight paper materials, and so on. The package may be suitable for use in a variety of packaging applications, including retort sterilization applications and/or refrigerated or frozen food applications. Further, the package may include more than one type of food item. In such embodiments, the package may include features that keep one food item separate from another.

The package may include one or more features that alter the effect of microwave energy on one or more food items, or certain portions thereof, contained within the package. Such features may generally comprise microwave energy interactive material that may be configured in various ways. In one example, the microwave energy interactive material may comprise a plurality of metallic foil elements disposed in selected panels of the pouch. The foil elements may be configured to reflect microwave energy away from, or direct microwave energy towards, various portions of the food item to optimize heating. As a result, the food in the package can be heated more uniformly. Such features may also be used to provide areas of the package that may be handled comfortably after heating in a microwave oven. As another example, the microwave energy interactive material may comprise a thin layer of microwave energy interactive material that is operative as a susceptor that prevents direct transmission of some (e.g. from about 12.5% to about 60%) of the microwave energy to the food, converts some (e.g., from about 27% to about 50%) of the microwave energy into thermal energy, which can then be transferred to the food item, and transmits the remainder of the microwave energy to the food. As yet another example, a combination of susceptor elements and foil elements may be used to selectively increase or decrease heating of various parts of the package contents. Notably, such materials may be used without causing the package to scorch or melt.

Additional aspects, features, and advantages of the present invention will become apparent from the following description and accompanying figures.

BRIEF DESCRIPTION OF THE DRAWINGS

The description refers to the accompanying schematic drawings in which like reference characters refer to like parts throughout the several views, and in which.

DESCRIPTION

Various aspects of the invention may be understood further by referring to the figures. For purposes of simplicity, like numerals may be used to describe like features. It will be understood that where a plurality of similar features are depicted, not all of such features necessarily are labeled on each figure. It also will be understood that the various components used to form the constructs may be interchanged. Thus, while only certain combinations are illustrated herein, numerous other combinations and configurations are contemplated hereby.

FIGS. 1A-1H schematically illustrate an exemplary microwave heating package 100 for containing and/or preparing one or more food items (e.g., food) in a microwave oven. The package 100 may generally comprise a plurality of panels joined to one another. The panels may be flexible and may be configured in a variety of ways, as will be discussed further below.

Figure 1A:
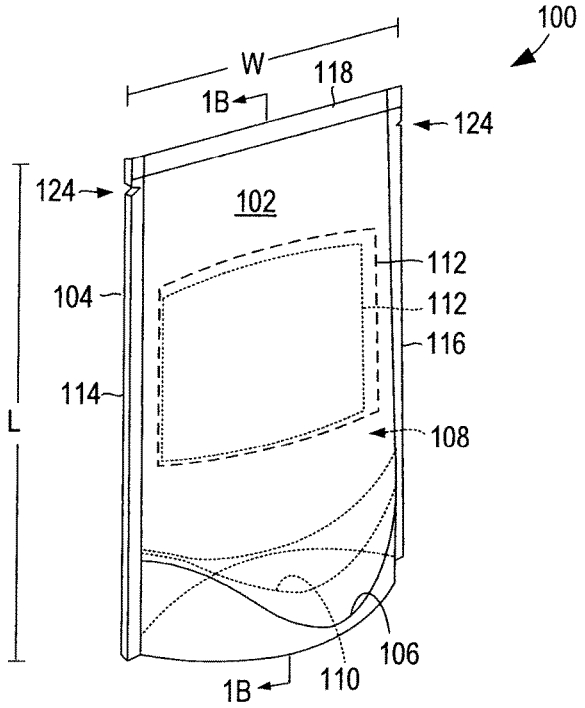
FIG. 1A is a schematic perspective view of an exemplary microwave heating package.
Figure 1B:
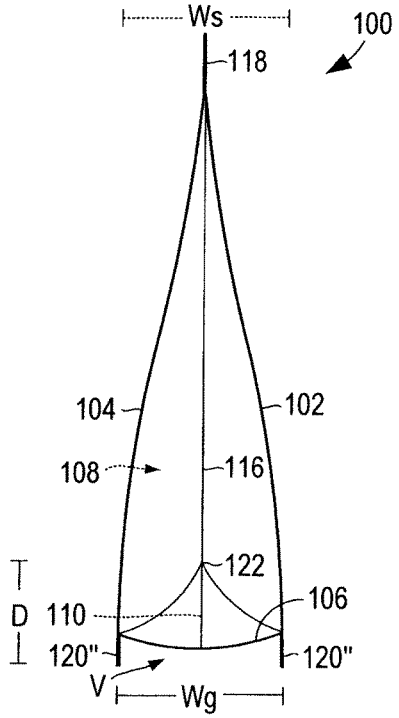
FIG. 1B is a schematic cross sectional view of the microwave heating package of FIG. 1A, taken along a line 1B-1B.

As shown in FIGS. 1A and 1B, package 100 may comprise a stand up pouch including a pair of opposed panels (e.g., main panels) 102, 104 (e.g., first or front panel 102 and second or back panel 104) and a bottom panel 106 (e.g., third panel 106) that are joined to one another to define an interior space 108 for receiving and containing food. Panels 102, 104 serve as walls for the package and panel 106 serves as a base for the package when the package 100 is in an upright configuration. The bottom panel 106 may be pleated (i.e., provided with a line of weakening, such as a fold line, score, or crease 110) or may be otherwise pliable, so that the bottom panel 106 is capable of being folded into the interior space 108 of the package 100, as shown schematically in FIGS. 1C and 1D. Stand up pouches with these pleated gussets or pliable gusset-like bottom panels are often premade and transported to food or other product processing plants for filling, sterilization or other further treatments. The ability of such empty pouches to be transported in a substantially flattened configuration makes it practical for pouch fabrication to be done at large geographic distances from filling operations.

Figure 1C:
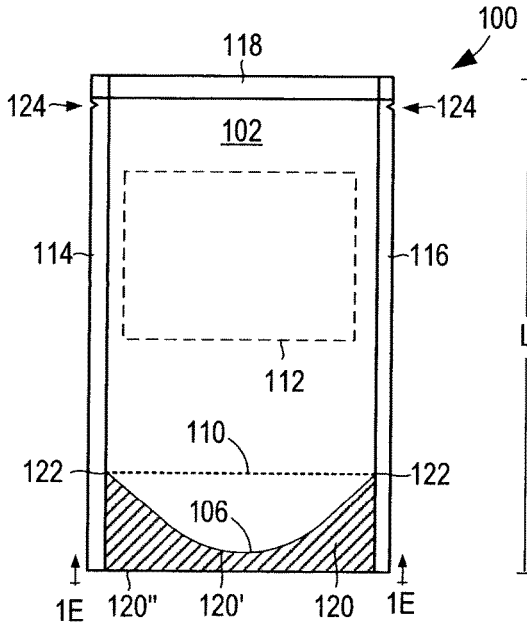
FIG. 1C is a schematic front elevation view of the microwave heating package of FIG. 1A, in a substantially flattened configuration.

The bottom panel 106 (e.g., being in the form of a folded or pleated gusset or being otherwise pliable) is operative for increasing or decreasing a distance between panels 102, 104. In this manner, the package 100 can be transitioned from a substantially flattened configuration in which panels 102, 104 are in a substantially planar, facing relationship (e.g., when empty or filled only partially) (FIG. 1E) to an expanded configuration (e.g., with the fold line or crease 110 being proximate to a lowermost portion of the interior space 108) in which panels 102, 104 are at least partially distanced from one another (FIG. 1F). It will be noted that in the substantially flattened configuration, the bottom panel 106 may be folded onto itself at least partially along the line of weakening 110 (where provided). However, even if no line of weakening is provided, the bottom panel 106 may nonetheless be folded onto itself due to the flexible nature of the bottom panel 106.

Figure 1D:
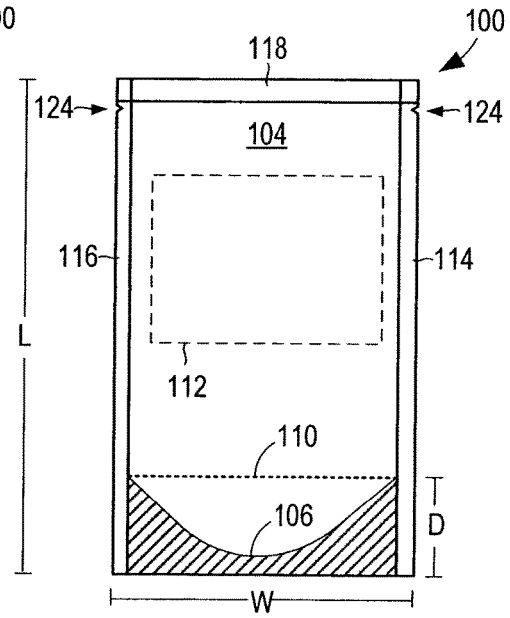
FIG. 1D is a schematic rear elevation view of the microwave heating package of FIG. 1A, in a substantially flattened configuration.
Figure 1E:
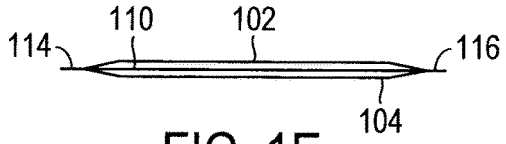
FIG. 1E is a schematic bottom plan view of the microwave heating package of FIG. 1C, taken along a line 1E-1E.
Figure 1F:
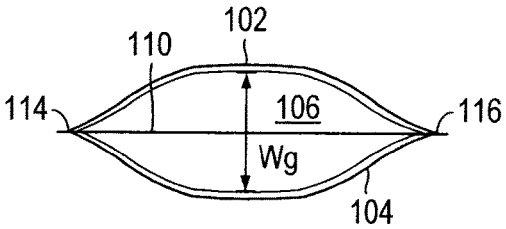
FIG. 1F is a schematic bottom plan view of the microwave heating package of FIG. 1C, taken along a line 1E-1E, in an expanded configuration.

The package may be generally characterized as having a length L (i.e., height when positioned in an upright configuration), width W, a side width Ws (FIG. 1B), and a gusset depth D (FIGS. 1B and 1D). The distance between the panels 102, 104 at the bottom of the interior space 108 defines a gusset width Wg (e.g., a maximum gusset width) (FIG. 1F). This also defines a maximum bottom separation between panels 102, 104.

Thus, when viewing a vertical cross-section of the at least partially filled package 100 along a midpoint of the package width W, as shown in FIG. 1B, the side width Ws may generally increase moving from the upper (closed) end (i.e., top) of the package (e.g., proximate to the top seal 118) towards the lower end (i.e., bottom) of the package (e.g., along the bottom panel 106). This increase in side width becomes less pronounced as one moves from the same midpoint of the package width W towards the peripheral edges of panels 102, 104 (e.g., towards side seals 114, 116, discussed below). Thus, when viewed along this midpoint, the maximum separation of panels 102, 104 decreases both when moving upwardly away from the bottom panel 106 and when moving away from this midpoint towards the peripheral edges of panels 102, 104.

Further, given the inherent shape of the package 100, for any given vertical or horizontal cross-section of the filled package 100, it will be noted that the package lacks radial symmetry around the centerpoint of that cross-section (see Example 1). The food in such a pouch is forced into an extremely complex shape, especially when compared to the shape of food in a typical rectangular, round, oval or commonly shaped tray, where the vertical food thickness exists between the walls of the tray is essentially constant. In a cup, radial symmetry, constant food depth, and a food radius that is constant (or only slightly increasing for tapered cup) presents a highly uniform surface and cross-section to impinging microwave energy. The food shape in a stand up pouch creates a far greater challenge to even heating than package types considered to this point. Thus, it will be appreciated that this highly irregular package geometry presents unique heating challenges.

Accordingly, one or both of panels 102, 104 may include one or more microwave energy interactive areas or regions 112 (indicated generally with dashed lines in FIGS. 1A, 1C, and 1D). Such areas or regions may comprise microwave energy interactive material configured as one or more microwave energy interactive elements or components that alter the effect of microwave energy on the package contents. In the illustrated embodiment, panels 102, 104 each include a microwave energy interactive area 112 in an opposed (and optionally substantially aligned) relationship with one another. It is also contemplated that panel 106 may include a microwave energy interactive area (not shown). The precise position of the microwave energy interactive areas and material may vary for each heating application, depending on the dimensions of the pouch, the type and amount of food item used, the desired heating time, and so on, as will be discussed further below.

As will be known to those of skill in the art, panels 102, 104 may be positioned in an opposed, facing relationship and joined to one another along one or more peripheral areas or margins (i.e., adjacent to the peripheral edges of the panels) by forming a heat seal or by using any other suitable technique. For example, as shown schematically throughout the figures, panels 102, 104 may be joined to one another along respective side marginal areas to form first and second side (or side edge) seals or areas 114, 116 and a top (or top edge) seal 118 along respective upper marginal areas of panels 102, 104.

The bottom panel 106 may be joined to each of panels 102, 104 along respective peripheral margins of the panels 102, 104 to form a bottom seal (or gusset seal) 120 (indicated schematically with hatch marks in FIGS. 1C and 1D). In this example, the gusset seal 120 extends downwardly from gusset apexes 122 (i.e., intersection points) at a gusset depth D along or adjacent to the side seals 114, 116, so that a top edge 120' (i.e., closest to the top end of the package 100) of the gusset seal 120 has a generally arcuate shape.

Further, the gusset seal 120 extends between the side seals 114, 116 along the lower or bottom peripheral edge of the package, so that a lower margin or bottom edge 120" of the gusset seal 120 extends below the bottom panel 106 when the bottom panel is expanded, as shown in FIG. 1B. The downwardly extending portion 120" of the gusset seal 120 serves as a support element 120" that defines a void V beneath the bottom panel 106 when the pouch 100 is positioned in an upright configuration (FIG. 1B).

Figure 1G:
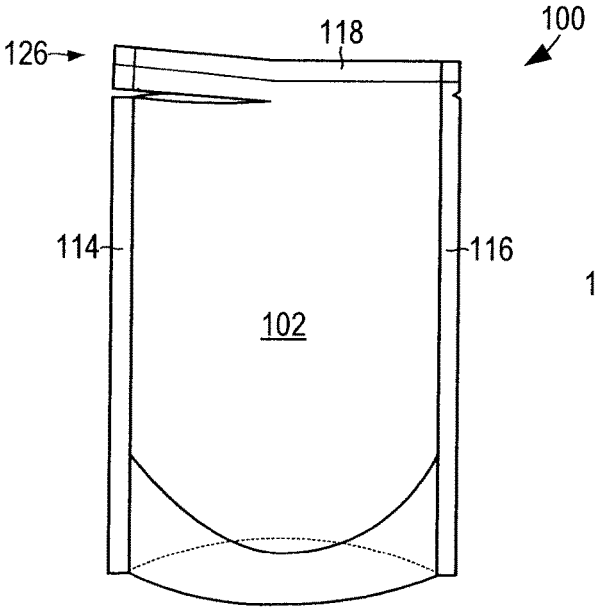
FIG. 1G is a schematic front perspective view of the microwave heating package of FIG. 1A, in a partially opened configuration.
Figure 1H:
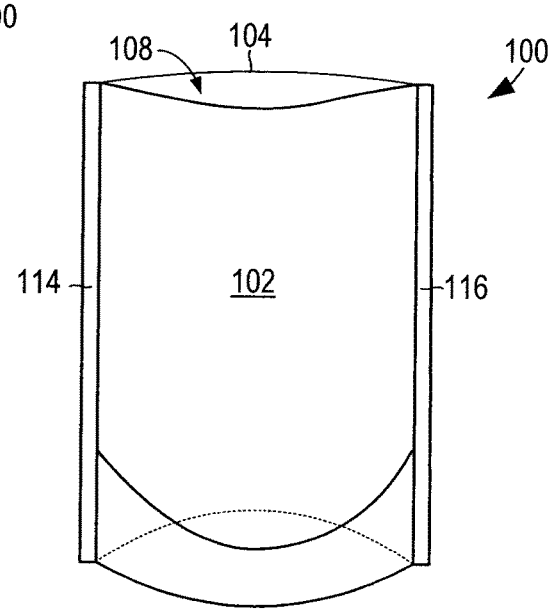
FIG. 1H is a schematic front perspective view of the microwave heating package of FIG. 1A, in a fully opened configuration.

If desired, the package 100 may include one or more notches 124 (FIG. 1A) within the side seals 114, 116 to facilitate venting of the package prior to microwave heating and/or to facilitate opening the package after heating, as shown schematically in FIG. 1G. Specifically, the notches may be used to initiate a tear across at least a portion of the package 100. If desired, the package 100 may also include a partial score (not shown) that facilitates tearing along the score line to assist with opening the package 100. For example, the score may comprise a partial depth cut in the respective panel 102, 104. Partial depth scores can be provided using mechanical, laser, or other means. Other tear facilitating technologies, such as technologies that ensure straight and uniform tearing across, for example, the width of the package may also be employed for convenience and reliability. The notches 124 and/or score may be used to at least partially remove an upper portion 126 of the package 100, including at least a portion of the top seal 118, as shown in FIG. 1H. In some instances, the user may be instructed to initiate a tear to provide venting of the package during heating. Optionally, reclose features such as interlocking zipper portions (not shown) may be incorporated, generally lower than the location of notches 124.

Figure 1I:
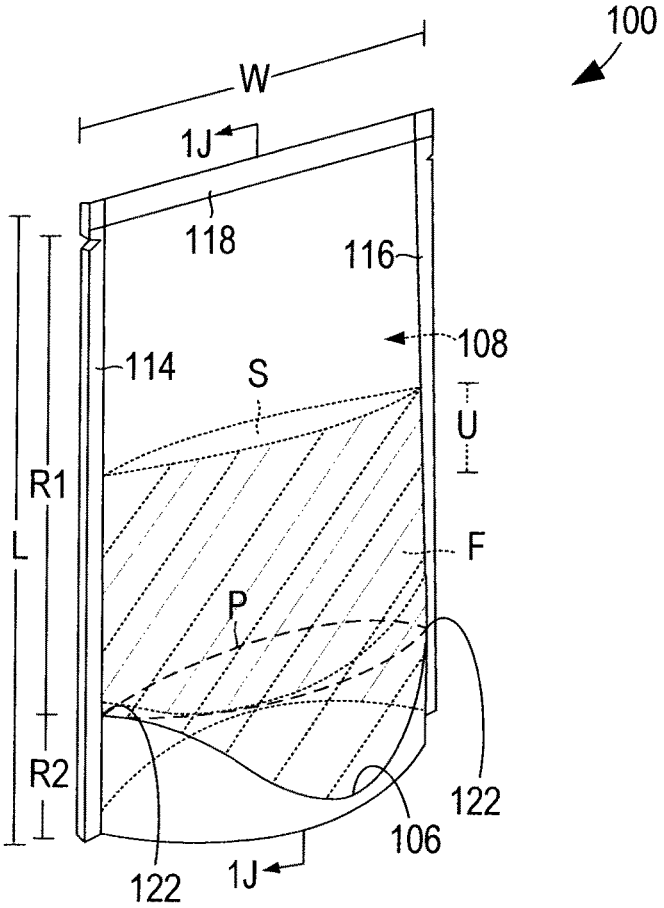
FIG. 1I is a schematic perspective view of the package of FIG. 1A, including food.
Figure 1J:
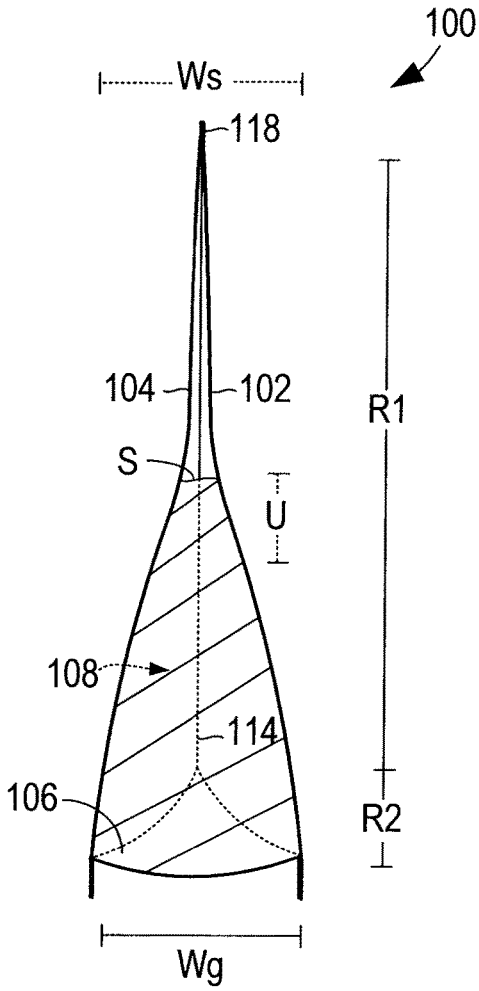
FIG. 1J is a schematic cross sectional view of the microwave heating package of FIG. 1I, taken along a line 1J-1J.

As stated previously, when the package 100 is positioned in an upright configuration, the package and its contents have an irregular geometry. By way of example, FIGS. 1I and 1J schematically illustrate the package of FIG. 1A partially filled with food F (shown schematically with hatch marks). As will be apparent from the drawings, the cross-sectional area of the interior space 108 of the package 100, and therefore package contents, varies along the length L and width W of the package. This is the case even when the package is not completely filled; the inherent geometry of stand up pouches with a bottom or gusset panel providing the stand up feature as well as creating additional usable interior volume compared to conventional pouches without gussets ensures that even a readily flowable, homogeneous food product will have a highly uneven shape when contained in the pouch. Accordingly, the food at each position in the package may experience a different level of microwave heating.

Furthermore, the flexible nature of the package 100 in general and the expandability of the bottom panel (i.e., the unfolding of the bottom panel 106) cause the package geometry (and therefore the geometry of the interior space 108 and its contents F) to vary. For example, for foods that have a low viscosity, one would expect the food to settle to the bottom of the package as shown in FIGS. 1I and 1J. Under ideal conditions (i.e., in which the food has settled to the bottom of the package), the ratio of the side width Ws of the interior space 108 along the widest part of the fill level (i.e., top surface S) of the food item to the side width Ws as measured along the widest part of the gusset region R2 may be from about 0.5 to about 0.85, for example, from about 0.6 to about 0.75. However, the package geometry can easily be altered by compressing the lower end of the package 100 and/or compressing the bottom panel 106. Depending on the inherent stiffness of the panels and/or the package construction, such compression might remain even when the compressive force is released. With more viscous foods and or foods with solid pieces or chunks of food, the package geometry may vary further (e.g., as the package is handled), since the user may compress the lower end of the package and cause the food to be moved upwardly within the interior space, where it might remain. Less uniform and less flowable food products are likely to have even more uneven shapes or profiles. Heavier food products will also induce bulging of the flexible structure, further creating uneven food geometry. The fill level of the package may also determine how the contents are configured within the interior space.

As a result of these and other variables, the food may be prone to underheating in areas where there is more bulk content (e.g., near the bottom of the package) and overheating in areas where there is less bulk content (e.g., near the top of the package). The uppermost portion of the food might be particularly prone to overheating, since microwave energy can impinge the surface of the food directly.

Accordingly, the interior space 108 may be characterized as having a plurality of regions or zones (e.g., heating regions or zones), the contents of each of which may respond differently to microwave energy. For example, the interior space 108 may be divided into a first region R1 (e.g., an upper region or taper region) that may comprise the upper portion of the interior space 108, extending from the top seal 118 to the uppermost portion of the gusset seal 120 (i.e., to a theoretical plane P extending between gusset apexes 122), and a second region R2 (e.g., a lower region or gusset region) that may comprise the area below and contiguous with the first heating region R1, extending from the plane P to the bottom panel 106. Other regions (e.g., food surface region, edge regions, seal regions, and so on) may also be defined as needed for a particular heating application.

Given the irregular nature of the package geometry, it is difficult to describe the shape of such regions. Nonetheless, by way of example and not limitation, the first (e.g., upper) region R1 may be somewhat or substantially rectangular frustum shaped. The second (e.g., lower or gusset) region R2 may be somewhat or substantially spherical cap shaped (i.e., like a portion of a sphere cut by a plane). Depending on the package dimensions, the first region R1 may comprise from about 70% to 90% of the package length, for example, from about 75% to about 85% of the package length. The second region R2 may comprise from about 10% to about 30% of the package length, for example, from about 15% to about 25% of the package length. However, other possibilities are contemplated.

Notably, the first region R1 typically includes the upper (e.g., top) surface S and upper (e.g., top) portion U of the food F, which is often prone to overheating in conventional packages. The precise location of the top surface of the food may vary. In many applications, the package may be filled, for example, from about 35% to about 75% or from about 40% to about 60%, for example, about 50% of the package length (which may also roughly correspond to similar percentages of the volume of the interior space). Further, as discussed above, the position of the top surface S of the food may change depending on the type of food, how the package is handled, and so on. Additionally, the precise thickness, shape, area, and volume of the upper portion U of the food that may overheat varies depending on the type of food and how it responds to microwave energy.

As stated above, the package 100 may be provided with one or more microwave energy interactive areas 112 (FIGS. 1A, 1C, and 1D) comprising microwave energy interactive material configured as one or more microwave energy interactive elements that alter the effect of microwave energy on the food item F within the package. Each area may comprise the same configuration or a different configuration of microwave energy interactive elements or materials.

The present inventor has discovered that the use of microwave energy interactive elements that are properly configured and positioned may alter the heating profiles of the various regions (e.g., regions R1, R2) of the package, so that the contents of the package can be heated more evenly, and within the desired amount of time, without overheating. Thus, in sharp contrast to currently available retort pouches that either provide 100% shielding (e.g., retort pouches including a continuous foil barrier layer, which are not suitable for use in a microwave oven) or 100% transmission (e.g., retort pouches with only polymeric barrier materials), the use of microwave energy interactive elements in the present packages allows the heating characteristics of each package to be fine-tuned for the particular package and package contents.

The microwave energy interactive areas 112 (and therefore microwave energy interactive material 112) of panels 102, 104 may be positioned so that the microwave energy interactive material is adjacent to either or both regions R1, R2 of the interior space 108. For example, in one particular embodiment, the microwave energy interactive areas 112 (and therefore microwave energy interactive material 112) of panels 102, 104 may be positioned so that the microwave energy interactive material is adjacent to region R1. In another particular embodiment, the microwave energy interactive areas 112 (and therefore microwave energy interactive material 112) of panels 102, 104 may be positioned so that the microwave energy interactive material is adjacent to region R1, and extends above and below the top surface S of the food F. Another particular embodiment may be similar to the previous example, except that the microwave energy interactive areas 112 (and therefore microwave energy interactive material 112) of panels 102, 104 may also extend into region R2. Numerous other possibilities are contemplated.

To use the package 100 according to one exemplary method, the user may be instructed to tear along one or both notches 124 (where included) to allow the package contents to be vented during heating. Alternatively, the pouch 100 may be provided with a self-venting feature (not shown) that eliminates the need to manually open vent areas in the package prior to heating. During heating, the microwave energy interactive elements 112 provide the desired degree of heating of various parts of the package contents so that the food item(s) are heated to the desired temperature. The presence of the microwave energy interactive elements allows the various portions of the food to be heated more evenly, even though the package has an irregular geometry (that even for identical product sales units may further vary depending on handling by the consumer). Additionally or alternatively, microwave energy interactive material that is configured to reflect microwave energy may be used in selected areas (e.g., along the side seals 114, 116 and/or top seal 118) to provide comfortable handling of the food item after heating.

FIGS. 2-12 illustrate several exemplary packages (e.g., pouches) 200, 300, 400, 500, 600, 700, 800, 900, 1000, 1100 that may be formed using the principles of the present invention. The various packages or pouches include features that are similar to package 100 shown in FIGS. 1A-1J, except for variations noted and variations that will be understood by those of skill in the art. For simplicity, the reference numerals of similar features are preceded in the figures with a "2" (FIG. 2), "3" (FIG. 3), "4" (FIG. 4), "5" (FIG. 5), "6" (FIG. 6), "7" (FIG. 7), "8" (FIG. 8), "9" (FIG. 9), "10" (FIG. 10), or "11" (FIG. 11) instead of a "1". Also, for simplicity, only one side (e.g., the front) of the package is shown. Thus, it will be appreciated that the other side (e.g., the back) of the package may include a similar microwave energy interactive area including the same or different configuration of microwave energy interactive material and/or elements. An exemplary fill level or top surface S is provided for purposes of reference and not limitation. However, other fill levels are contemplated.

Figure 2:
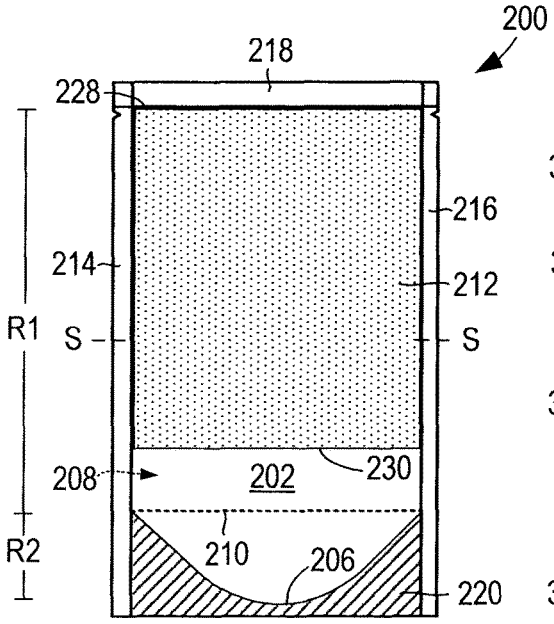
FIGS. 2-13 schematically illustrate a front side of various exemplary pouches formed according to the disclosure.
Figure 3:
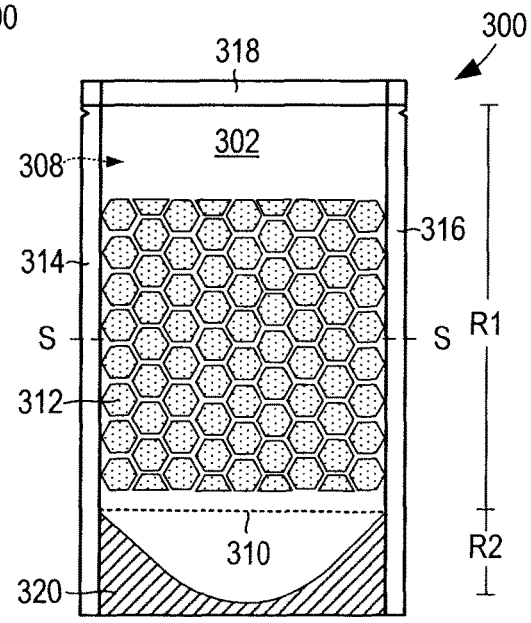

In the exemplary package 200 shown schematically in FIG. 2, the microwave energy interactive areas comprise microwave energy interactive material 212 that is operative for reflecting microwave energy (sometimes referred to as a microwave energy shielding element). For example, the microwave energy interactive material may be configured as a patch of metal foil having a thickness of from about 5 to about 10 micrometers, for example, about 7 micrometers, or high (greater than about 1.0) optical density evaporated material having a thickness of from about 300 to about 700 or more angstroms. Such elements typically are formed from a conductive, reflective metal or metal alloy, for example, aluminum, copper, or stainless steel, but other suitable materials may be used.

In this example, the microwave energy interactive material (e.g., metallic foil patch) 212 is positioned so that the microwave energy interactive material is adjacent to a portion of the upper region R1 of the interior space 208. The metallic foil patch 212 has an upper edge 228 that is positioned above the top surface S of the food, and a lower edge 230 that is positioned below the top surface S of the food, so that microwave energy is reflected away from the upper portion U of the food, which is often prone to overheating. As a result, the upper portion U of the food is heated at a reduced rate relative to the remainder of the food, so the food item can be heated to its desired temperature without overheating the upper portion U of the food.

In the exemplary package 200 of FIG. 2, the metallic foil patches 212 extend substantially to the top seal 218. Since the opposed metallic foil patches 212 converge towards one another with panels 202, 204, the patches 212 collectively serve as a "tent" for substantially covering the top surface of the food. This is in sharp contrast to conventional shielding applications, in which the top surface of the food is shielded only around its periphery (e.g., as in the case of a beverage with a shielding "band" extending around the cup).

In other embodiments, the foil patch 212 may not extend substantially to the top seal 218. This may be desirable, for example, where the food item needs some degree of shielding to provide an even temperature profile in the heated food, but does not need the level of shielding provided by a full length (i.e., height) metallic patch. For example, in this and other embodiments, the microwave energy interactive material may extend above the food surface S so that the microwave energy interactive material is adjacent to about (or at least about) 5%, about (or at least about) 10%, about (or at least about) 15%, about (or at least about) 20%, about (or at least about) 25%, about (or at least about) 30%, about (or at least about) 40%, about (or at least about) 45%, about (or at least about) 50%, about (or at least about) 55%, about (or at least about) 60%, about (or at least about) 65%, about (or at least about) 75%, about (or at least about) 80%, about (or at least about) 85%, about (or at least about) 90%, about (or at least about) 95%, up to 100%, or any range thereof, of the void space above the food item. Further, in this embodiment, the microwave energy interactive area or material is adjacent only to the upper region R1 of the interior space 208. However, it is contemplated that in this and other embodiments, the microwave energy interactive or material may extend into the second region R2 as well.

If desired, the metallic foil patch 212 may be spaced from side seals 214, 216 to prevent overheating in such areas (e.g., due to edge effects of foil patches, as is readily understood by those of skill in the art).

It will be noted that, in many cases, the package may be filled to only from about 35% to about 65%, for example, from about 40% to about 60% of the package volume, so that when the bottom panel 206 is expanded, the contents fill (i.e., are disposed along) only from about 35% to about 65%, for example, from about 40% to about 60% of the package length (i.e., height). Thus, there is typically a head space above the food item in which panels 202, 204 (hidden from view) are free to be in a proximate and/or contacting relationship with one another (e.g., as shown in FIG. 1J). Furthermore, as discussed above, due to the often deformable nature of the package contents, the panels may be brought towards one another without food disposed therebetween when being handled by the user. As a result, the distance between the microwave energy interactive elements of panels 202, 204 (and the microwave energy interactive material in such areas) may vary significantly. For example, if panels 202, 204 are brought into a contacting relationship, the distance between the microwave energy interactive elements of panels 202, 204 may be less than 0.5 mm, for example, less than 0.25 mm, depending on the thickness of the panels.

Prior to the present invention, it was generally believed that the use of shielding materials (e.g., foils and high optical density materials) in a microwavable pouch should be avoided because of the potential for arcing; thus, many pouch manufacturers have sought to find materials that replace the foil barrier materials of conventional pouches. It was also believed that the addition of microwave energy interactive elements to flexible, film-based pouches would cause undesirable melting or scorching of the package. However, the present inventor has discovered that the field intensities associated with bulk metallic material are well tolerated by the types of laminated structures commonly used in stand up pouches, particularly for retort sterilization applications. Continuous foil patches of varying shapes and sizes disposed on package panels whose inside surfaces contact or are nearby to food were robust and stable in the tests performed. Unlike paperboard trays, which are prone to drying out and scorching, the present packages have been found to withstand heating without melting or scorching. This is surprising and unexpected.

Nonetheless, it is contemplated that in some instances, depending on the food item, the way the package is handled, the fill level, and so on, all or a portion of the microwave energy shielding elements on the opposite panels of the package may be too close to one another. Any bulk metallic substance can carry very high induced electric currents in response to a high, applied electromagnetic field in a microwave oven cooking environment. The larger the size of the bulk metallic materials used in the package, the higher the potential induced current and induced voltage generated along the periphery of the bulk metallic substance. Induced voltage can also increase at tears, cuts, or points resulting from folding a sheet of the bulk metallic material.

Accordingly, to provide an additional level of certainty that the package will not scorch, all or a portion of the metallic patch may be replaced with a plurality of smaller metallic elements (e.g., microwave energy reflective/shielding elements) that do not tend to create the higher field intensity effects associated with larger metallic patches. For example, in the package 300 of FIG. 3, the microwave energy interactive material may be configured as an array of microwave energy reflective elements 312 spaced apart from one another. Each of such elements 312 may comprise a metallic foil or high optical density material operative for reflecting microwave energy. This repeated pattern or array of solid, microwave energy reflective shapes is substantially opaque to incident microwave energy so as to increase reflection of microwave energy while allowing minimal microwave energy absorption. Each shape in the array acts in concert with adjacent shapes to reflect a substantial percentage of the incident microwave radiation, thus shielding the food locally and preventing overcooking. Thus, even though the spaced apart elements 312 may allow some microwave energy to be transmitted through the panels 302, 304 (hidden from view), the plurality of elements still collectively provide a substantial shielding effect to reflect a substantial portion of microwave energy away from the upper portion U of the food. This may be particularly effective with the geometry of stand up pouches, since the microwave energy interactive elements 312 taper towards one another with the tapering of panels 302, 304 towards the top seal 318 to provide a tenting effect, as discussed above.

Notably, in the absence of a dielectric load (i.e., food), the microwave energy generates only a small induced current in each reflective shape and hence a very low electric field strength close to its surface; with introduction of a dielectric food load, the current is even further reduced. A pattern of small reflective shapes can result in reductions of field intensification compared to a bulk metallic sheet by a factor of 5 or more, the reduction increasing in magnitude as two interactive shielding elements are brought into close proximity to one another. Thus, an array of reflective shapes may find particular utility in a stand up pouch, in which opposed microwave energy interactive materials may be brought very close to one another in the course of normal consumer handling and heating.

In the illustrated example, the array of reflective elements 312 extends only partially to the top seal 318; however, the array of reflective elements 312 can extend to the top seal 318 if desired. Further, the array of reflective elements 312 may extend into the side seals 314, 316 if needed. The present inventor has discovered that these reflective arrays can be extended to the top of the package headspace or even placed in configurations where the inside surfaces of opposing panels where the arrays are disposed are in direct contact without any stability or detrimental interaction effects. This is surprising and unexpected.

The shape, dimensions, spacing of the reflective elements may vary for each application. In this example, the elements are substantially hexagonal in shape. Other suitable shapes may include circles, triangles, rectangles, squares, pentagons, heptagons, octagons, or any other regular or irregular shape. For example, elements 312 may have a major linear dimension (e.g., the distance between opposite flat sides of a hexagon) of, for example, from about 3 mm to about 15 mm, from about 5 mm to about 15 mm, or from about 6 mm to about 10 mm, for example, about 7 mm or about 9 mm. The elements may be spaced a distance of, for example, from about 0.5 mm to about 5 mm, from about 0.75 mm to about 3 mm, about 1 mm, or about 2 mm. In one specific example, the major linear dimension of the elements may be about 7 mm and the elements may be spaced a distance of about 2 mm apart. In another specific example, the major linear dimension of the elements may be about 9 mm and the elements may be spaced a distance of from about 1 mm apart.

A combination of microwave energy interactive elements may also be used. For example, in the package 400 of FIG. 4, a microwave energy shielding element 412*a* in the upper region R1 extends above and below the top surface of the food S (to a point closely proximate to the lower region R2). Additionally, an array of reflective shielding elements 412*b* extends from an upper edge 428 of the shielding element to a point closely proximate to the top seal 418 and into the side seals 414, 416 along the sides of the shielding element (e.g., to prevent any potential edge effects along the sides of the shielding elements).

Figure 4:
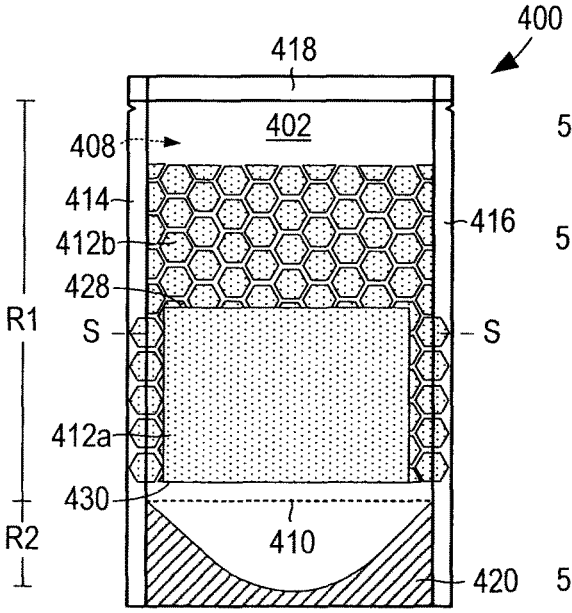
Figure 5:
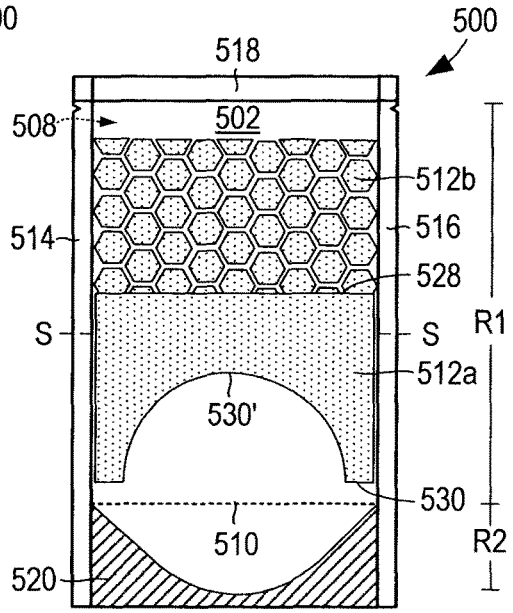
Figure 6:
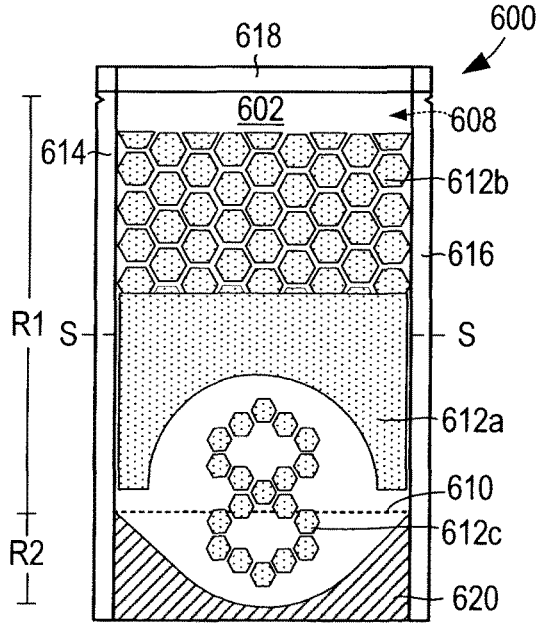

The package 500 of FIG. 5 is similar to the packages 400 of FIG. 4, except that the array of reflective elements 512*b* does not extend into the side seals 514, 516. Further, the microwave energy shielding element (e.g., patch) 512*a* includes an upper edge 528 that is substantially linear and a lower edge 530 that includes an inwardly arcuate portion 530'. The arcuate portion 530' is operative for exposing more of the lower portion of the upper region R1 to provide more bulk heating in this area.

Package 600 is a variation of the package 500 of FIG. 5 including similar elements 612*a*, 612*b*, but also includes a plurality of microwave energy reflective elements 612*c* that are configured as a plurality of loops operative for directing microwave energy towards specific areas of the food item, in this case, the lower portion of the upper region R1 and the lower region R2. If desired, the loops may be of a length that causes microwave energy to resonate, thereby enhancing the distribution effect. These elements may be described as microwave energy directing elements or microwave energy distributing elements, additional examples of which are described in U.S. Pat. Nos. 6,204,492, 6,433,322, 6,552,315, and 6,677,563.

Figure 7:
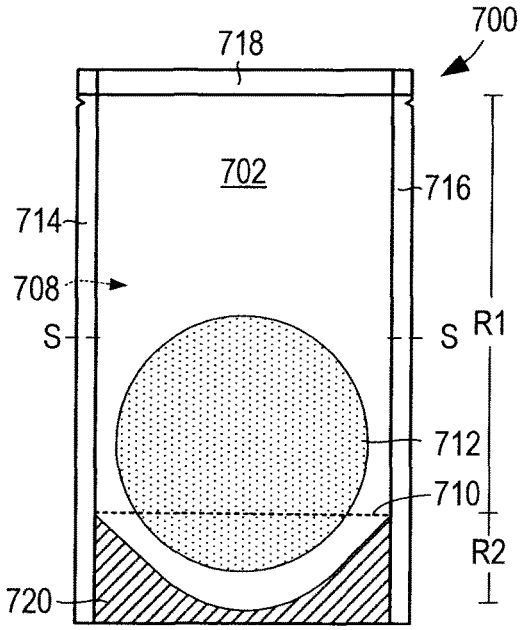
Figure 8:
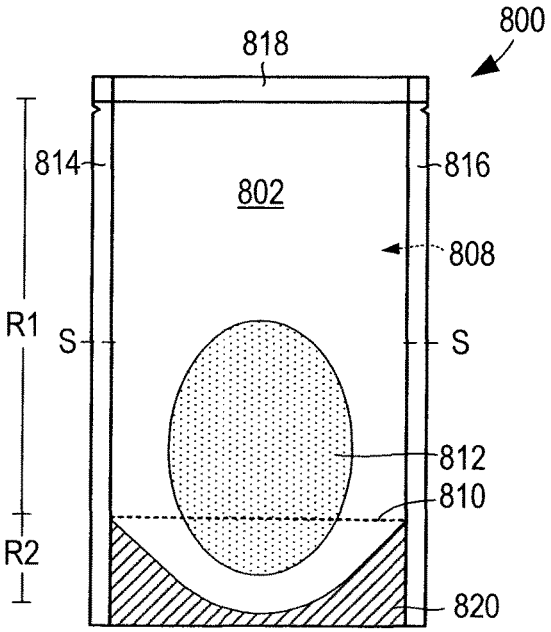

In the respective packages 700, 800 of FIGS. 7 and 8, a substantially circular or oval shielding patch 712, 812 is used to create an impedance matching effect, in which microwave energy is trapped between the patches on opposed panels 702, 704 (hidden from view); 802, 804 (hidden from view), so that a maximum amount of microwave energy is dissipated between the microwave energy shielding elements 712, 812. The patches extend slightly above the surface S of the food item within the upper region R1 and below the food item into the lower region R2.

Figure 9:
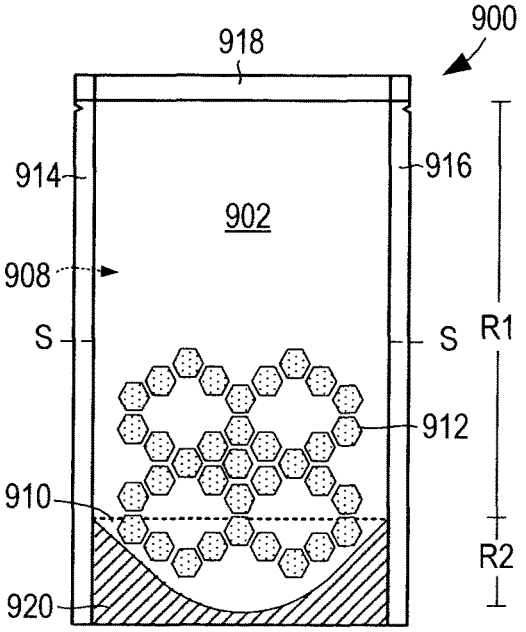
Figure 10:
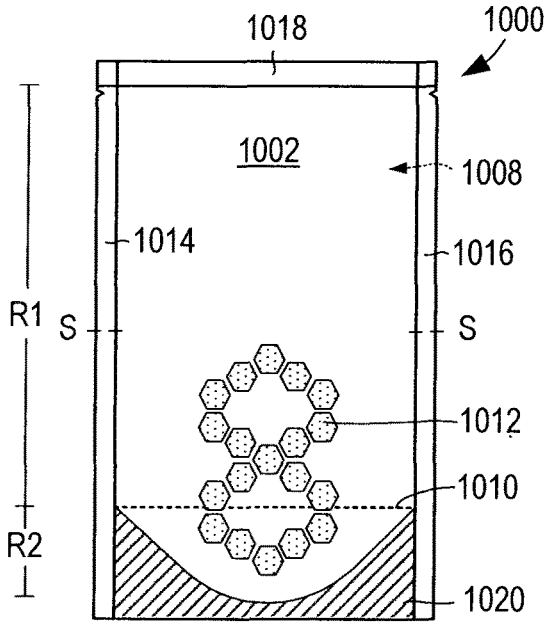

FIGS. 9 and 10 illustrate exemplary packages 900, 1000 including only microwave energy distributing elements 912, 1012 that are positioned adjacent to both the upper region R1 below the food surface S and the lower region R2 to enhance heating of the food both in the lower portion of the upper region R1 and in the lower region R2.

Figure 11:
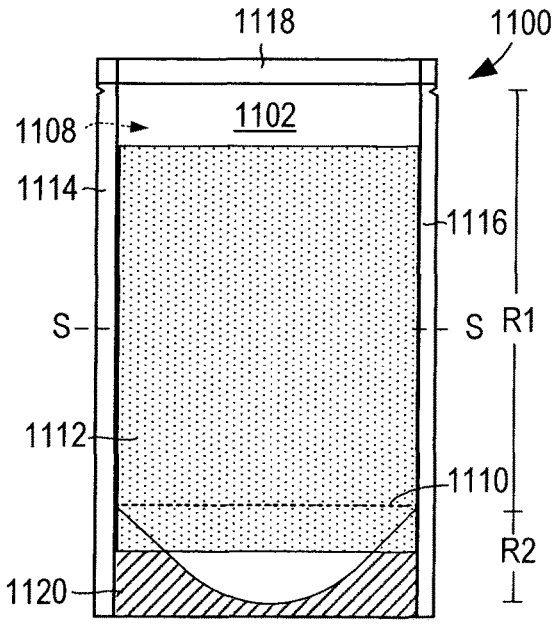

FIG. 11 illustrates a package 1100 including a dual (i.e., two susceptor layer) susceptor patch 1112 extending above and below the food surface S adjacent to the upper region R1 of the interior space 1108, and downwardly into the lower region R2. A susceptor typically comprises a thin layer of microwave energy interactive material (e.g., a metal, such as aluminum, or a non-metal, such as indium tin oxide), generally less than about 500 angstroms in thickness, for example, from about 60 to about 100 angstroms in thickness, and having an optical density of from about 0.15 to about 0.35, for example, about 0.17 to about 0.28. When exposed to microwave energy, the susceptor tends to absorb at least a portion of the microwave energy and convert it to thermal energy (i.e., heat) through resistive losses in the layer of microwave energy interactive material. The remaining microwave energy is either reflected by or transmitted through the susceptor.

Susceptors may be used to enhance the heating of an adjacent food item and also may provide some degree of temperature distribution modifying benefits, since they are not fully transparent as non-interactive areas would be. It has been surprisingly and unexpectedly been discovered that dual susceptor materials placed over large sections of the panels, including areas not in contact with food, were stable and experienced no degradation effects and did not inflict any heat related damage to the polymer structures of the panels. Thus, the discoveries of this invention open the door for the use of interactive materials for field modifications effects in flexible, pliable, and deformable packages made principally from polymer films.

If desired, the susceptor may include one or more transparent areas (not shown) to effect dielectric heating of the food item. Such areas may be formed by simply not applying microwave energy interactive material to the particular area, by removing microwave energy interactive material from the particular area, or by mechanically deactivating the particular area (rendering the area electrically discontinuous). Alternatively, the areas may be formed by chemically deactivating the microwave energy interactive material in the particular area, thereby transforming the microwave energy interactive material in the area into a substance that is transparent to microwave energy (i.e., microwave energy inactive).

By way of example, the susceptor may incorporate one or more "fuse" elements that limit the propagation of cracks in the susceptor structure, and thereby control overheating, in areas of the susceptor structure where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Patent Application Publication No. US 2008/0035634A1, and PCT Publication No. WO 2007/127371.

The microwave energy interactive material of the susceptor may comprise an electroconductive or semiconductive material, for example, a vacuum deposited metal or metal alloy, or a metallic ink, an organic ink, an inorganic ink, a metallic paste, an organic paste, an inorganic paste, or any combination thereof, that is operative as a susceptor. Examples of metals and metal alloys that may be suitable for forming a susceptor include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, microwave energy interactive material of the susceptor may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material of the susceptor may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material of the susceptor may be carbon-based, for example, as disclosed in U.S. Pat. Nos. 4,943,456, 5,002,826, 5,118,747, and 5,410,135.

In still other embodiments, the microwave energy interactive material of the susceptor may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

It will be appreciated that while a dual susceptor patch is described in detail herein, single layer or other multi-layer susceptors may be used. Further, various microwave energy interactive elements can be used in any combination as needed to bring about the desired heating result. Thus, for example, a susceptor can be used in combination with (e.g., in a superposed relationship with) an array of reflective elements. As another example, the microwave energy interactive elements of one panel may comprise a microwave energy shield, while the microwave energy interactive elements of the other panel may comprise a reflective array. As still another example, the microwave energy interactive elements of one panel may be of the type shown in FIG. 2, while the microwave interactive elements of the other panel may be of the type shown in FIG. 4. Countless other possibilities are contemplated.

The package may be formed from any flexible material that is substantially resistant to melting, scorching, combusting, or substantially degrading at typical microwave oven heating temperatures, for example, at from about 250° F. to about 425° F. As used herein, "flexible" materials may include pliable, easily flexurally yielding materials having a thickness of less than about 10 mils or 254 micrometers, for example, less than about 6 mils or 152 micrometers. Suitable flexible materials may have a flexural modulus of less than about 3800 $MN/m^2$ and a flexural strength of less than about 10 N/cm of width. In some examples, the flexural strength may be less than about 5 N/cm of width. Suitable flexible materials are typically polymer based and can generally take the shape of a bag, pouch, liner, or overwrap, or any other package having a shape that can be readily changed. This is in contrast to many other commercially available microwave energy interactive packages formed from paperboard, which typically has a basis weight of at least 250 $g/m^2$ (51 lbs./1000 sq. ft.) and a thickness of at least 300 micrometers (0.012 in.), or molded polymeric materials (e.g., coextruded polyethylene terephthalate (CPET) trays), which typically have at least some regions with a thickness of at least about 635 micrometers (0.025 in.).

Each panel of the package may comprise a plurality of materials in a layered configuration. For example, for retort applications, the panels may comprise a plurality of layers, as follows: biaxially oriented polyethylene terephthalate film (BOPET) (outside of package), optionally reverse printed/barrier polymer layer (e.g., EVOH, barrier nylon, etc.)/microwave energy interactive material (e.g., foil patch, patterned foil, susceptor)/BOPET film/retort grade cast polypropylene film (CPP) (inside of package).

In another example, the barrier polymer layer and adhesive between the BOPET and barrier polymer may be replaced with a barrier coating on the BOPET, as follows: BOPET film (outside of package), optionally reverse printed/barrier coating (e.g., SiOx, AlxOy, PVdC, etc.)/microwave energy interactive material (e.g., foil patch, patterned foil, susceptor)/BOPET film/CPP (inside of package).

Other examples of possible structures may include:

- BOPET (outside of package), optionally reverse printed/SiOx or AlxOy coated BOPET/microwave energy interactive material (e.g., foil patch, patterned foil, susceptor)/CPP (inside of package);
- BOPET (outside of package), optionally reverse printed/microwave energy interactive material (e.g., foil patch, patterned foil, susceptor)/biaxially oriented nylon (BON)/CPP (inside of package);
- SiOx or AlxOy coated BOPET (outside of package), optionally reverse printed/microwave energy interactive material (e.g., foil patch, patterned foil, susceptor)/BON/CPP (inside of package);
- BOPET (outside of package), optionally reverse printed/SiOx or AlxOy coated PET/microwave energy interactive material (e.g., foil patch, patterned foil, susceptor)/biaxially oriented nylon (BON)/CPP (inside of package);
- BOPET, or SiOx or AlxOy coated BOPET, or Nano-BON-Nano or Nano-BOPET-Nano (i.e., 2 side nanocomposite coated film, e.g., Kurarister™ films from Eval America (Kuraray)) (outside of package), optionally reverse printed/microwave energy interactive material (e.g., foil patch, patterned foil, susceptor)/CPP (inside of package);
- BON (outside of package), optionally reverse printed/microwave energy interactive material (e.g., foil patch, patterned foil, susceptor)/EVOH/CPP (inside of package); or
- PET-mPAA (BOPET coated with modified polyacrylic acid, e.g., Besala™ films from Kureha) or Nano-BON-Nano or Nano-BOPET-Nano (outside of package), optionally reverse printed/microwave energy interactive material (e.g., foil patch, patterned foil, susceptor)/BON/CPP (inside of package);

For non-retort applications, the various layers of the panels may comprise, for example, BOPET (outside of package) or BOPP, optionally reverse printed/microwave energy interactive material (e.g., foil patch, patterned foil, susceptor)/cast or machine direction oriented PP, PE, or other polyolefin film.

While several examples of possible structures are provided, it will be appreciated that countless other structures are contemplated for use with retortable and non-retortable packages. For example, the microwave energy interactive material may be supported on or joined to other heat resistant, dimensionally stable films. Also, while cast films are generally described above, other functionally acceptable films may be used. For example, one machine direction oriented film that may be suitable for use with the present invention has been disclosed in U.S. Patent Application Publication No. 2010/0055429A1. Such a film may be used to improve the reliability of tearing so that the package opens in a more predictable manner. Further, it will be appreciated that the various layers of the panels may be assembled in any suitable manner, for example, using adhesive bonding, thermal bonding, lamination, co-extrusion, or any other suitable technique. It is noted that these assembling layers (e.g., adhesive layers) are not shown in the above structure descriptions.

In some cases, for example, it may be desirable for the microwave interactive material to be formed into self-adhesive labels that can be easily applied to pouch panels during or after pouch fabrication. These could be especially useful in food service applications which provide a more controlled handling environment than consumer distribution and use channels.

If desired, the package may include one or more substantially optically transparent or translucent areas where the microwave energy interactive material is absent. Such areas may define windows for viewing the contents of the package. However, it will be appreciated that in the case of microwave interactive susceptor materials with reasonable light transmission, viewing windows may also be defined through the appropriate use of package print designs.

Still other variations are contemplated. For example, if desired, the package may be used to heat multiple food items. The interior of package may be separated into two or more compartments, for example, in an upright or side-by-side configuration (or otherwise). Each compartment may independently comprise (or may be devoid of) microwave energy interactive material for altering the effect of microwave energy on the contents of the particular compartment. The microwave energy interactive material may be configured to achieve the desired level of heating for the food items in the compartments. For example, a package may include a first compartment that includes an item to be steamed, and a second compartment that includes a steaming liquid (e.g., water or broth, which may initially be in a frozen condition where the package is used for frozen foods). The first compartment may be provided with microwave energy interactive material that reflects microwave energy to focus microwave energy on the steaming liquid in the second compartment.

In such an embodiment, the package may also include one or more features that allow the steam to be transferred from the second compartment to the first compartment. The feature(s) may be present in the package prior to heating or may be created during the heating process. For example, a wall separating the first compartment and the second compartment may be generally impermeable to liquid prior to heating. During heating, apertures may be formed in the wall to allow the steam to transfer to the first compartment. The apertures may be created in any suitable manner. In one example, the wall may include microwave energy interactive material that selectively melts the film to create apertures. Other possibilities are contemplated.

Figure 12:
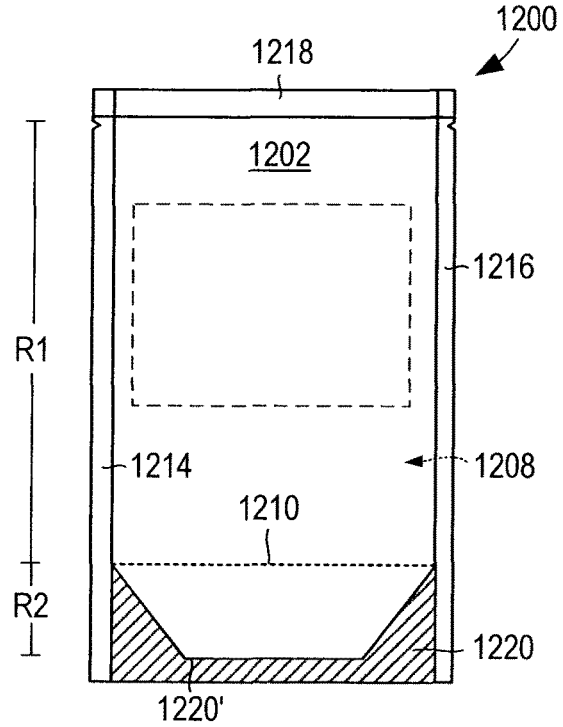
Figure 13:
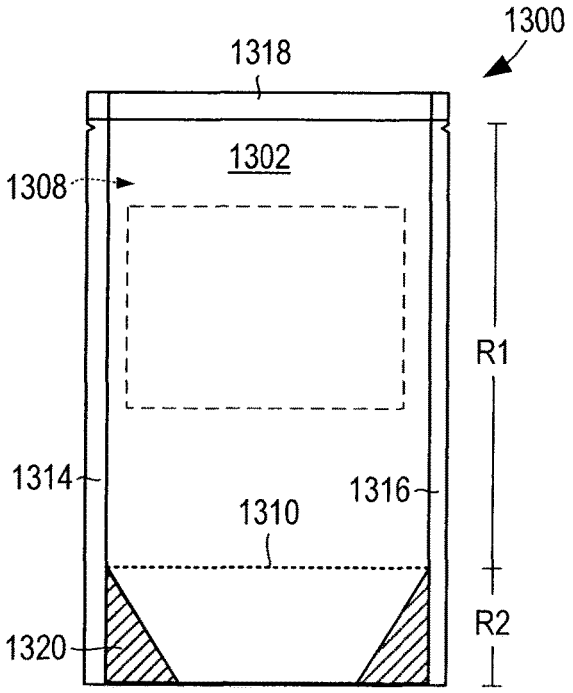

Furthermore, differently configured pouches are contemplated. For example, gusset seal shapes may be varied for visual design, standing stability or other reasons and will result in differently shaped voids beneath the package as well as other features of such pouches. Thus, while the arcuate top edge of the illustrated gusset seals (e.g., top edge 120' of FIG. 1C) that defines a "round-bottom" standup pouch is commonly used in the food packaging industry, other gusset seal shapes are contemplated. For example, FIGS. 12 and 13 illustrate exemplary packages (e.g., pouches) 1200, 1300 that include features that are similar to package 100 shown in FIGS. 1A-1J, except for variations noted and variations that will be understood by those of skill in the art. For simplicity, the reference numerals of similar features are preceded in the figures with a "12" (FIG. 12) or "13" (FIG. 13) instead of a "1". Also, for simplicity, only one side (e.g., the front) of the package is shown.

In the exemplary package 1200 of FIG. 12, the top edge 1220' of the gusset seal 1220 may have an angular U-shape (i.e., with a pair of linear portions extending obliquely and convergently downwardly towards a horizontal linear portion), as shown in FIG. 12. Further, as shown in FIG. 13, the gusset seal 1320 may be configured so that the bottom panel is not elevated above the lower peripheral margin of the gusset seal (when the bottom panel is expanded); in this example, the gusset panel and main panels are formed from a single web of flexible material that is folded and sealed to form the pouch. However, it will be understood by those of skill in the art that pouches having gusset seals of the types shown in FIGS. 1 and 12 can be formed from multiple webs of material (which may be the same or different) or from a single web from which longitudinal sections are slit during the pouch making operation. These types of pouches offer greater standing rigidity, but are more complicated to form. Nonetheless, such pouches may be advantageous for particular applications. Numerous other possibilities are contemplated.

Furthermore, although stand-up pouches are described in detail herein, the concepts embodied in this application may be applied to other types of bags, pouches (e.g., pillow pouches), and other microwave heating constructs, particularly those having an irregular geometry. Any of such packages or other constructs may include other features, for example, a closure feature (e.g., zipper, zipper/slider combination, closure flap, adhesive, and so on), dispensing feature (e.g., pour spout), or any other feature.

The present invention may be understood further in view of the following examples, which are not intended to be limited in any manner. All values are approximate unless noted otherwise.

EXAMPLE 1

A wet Plaster of Paris slurry was poured into a stand up pouch to a representative fill height and allowed to set after the top edge of the pouch was sealed. The pouch had a length of about 184 mm, a width of about 139 mm, a gusset depth of about 38 mm, side seam widths of about 10 mm, and a center bottom gusset seal width of about 5 mm with an arcuate shape to the top edge of the gusset seal area. The pouch was peeled from the surface of the resulting solid, which had taken the form of a representative product fill.

Figure 14A:
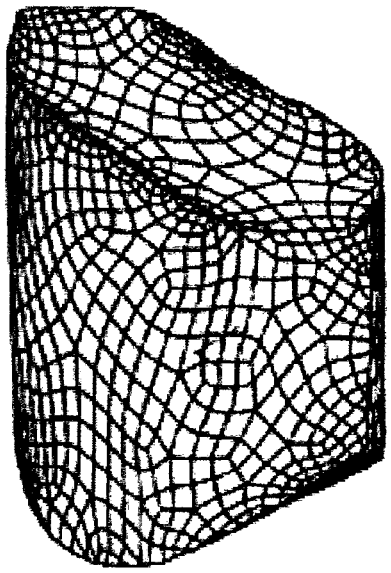
FIGS. 14A and 14B schematically illustrate the shape of the interior space of a stand-up pouch in a fully expanded configuration.
Figure 14B:
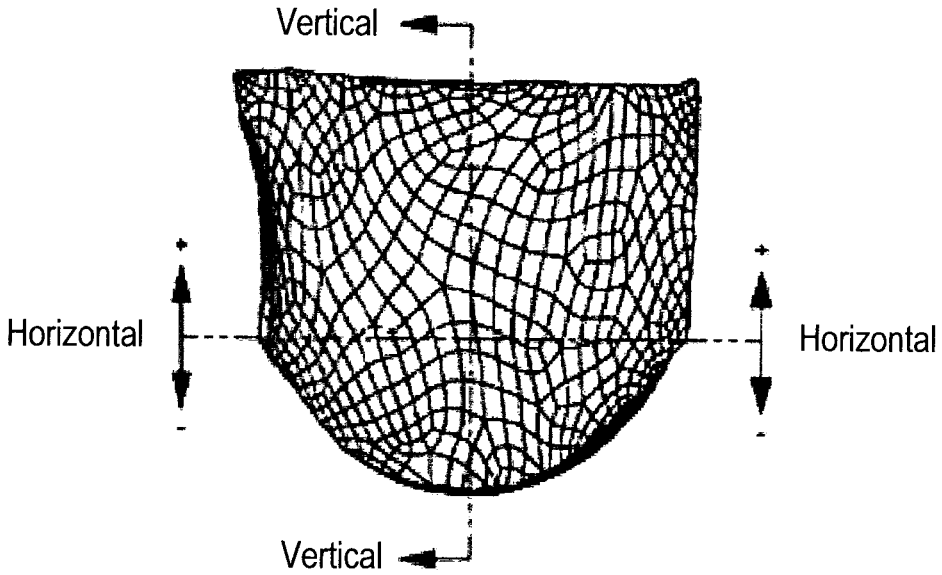
Figure 15A:
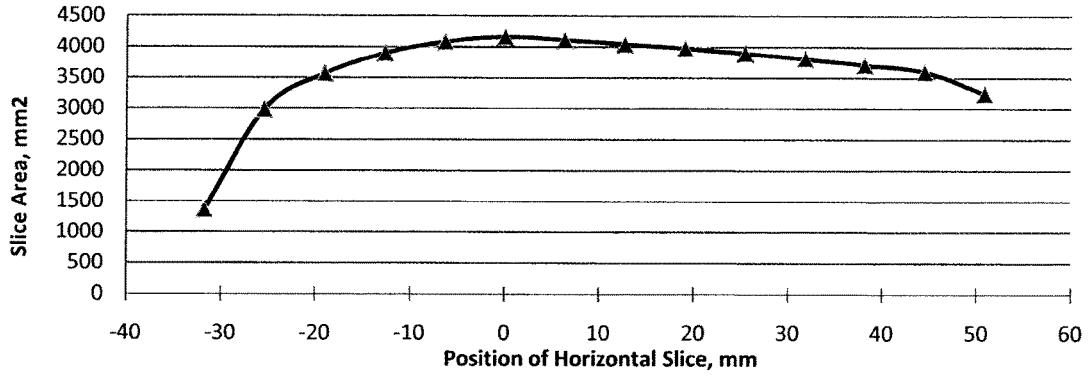
FIGS. 15A and 15B present a quantitative characterization of the stand up pouch interior space shown in FIGS. 14A and 14B.
Figure 15B:
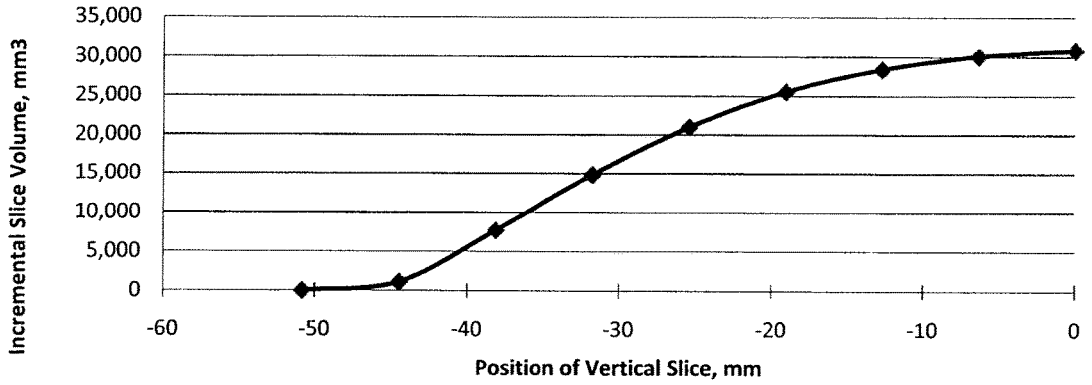

The resulting solid was digitally scanned and analyzed using standard 3D CAD modeling software, as shown in perspective view in FIG. 14A, in which the surfaces of the solid are shown as a web of lines generated by the digital scan of the solid. The solid representing the filled portion of the interior space of the pouch was digitally sectioned into horizontal slices having a thickness of about 0.25 in (6.35 mm) and vertical slices having a width of 0.25 in (6.35 slices) (note that only one half of the pouch was done for the vertical measurements because it was assumed that the plaster mold of the interior space would be substantially symmetrical around the vertical plane connecting the centerlines of the front and back panels). The zero (0) position for the horizontal slices was located at the gusset depth and the zero position for the vertical slices was located at the centerline vertical slice described above (FIG. 14B). The results are set forth in Tables 1 and 2 and FIGS. 15A and 15B.

TABLE 1

| Horizontal | | |
|---|---|---|
| Position (in.) | Position (mm) | Area (mm^2) |
| −1.25 | −31.75 | 1363 |
| −1.00 | −25.40 | 2990 |
| −0.75 | −19.05 | 3564 |
| −0.50 | −12.70 | 3895 |
| −0.25 | −6.35 | 4084 |

TABLE 1-continued

| Horizontal | | |
|---|---|---|
| Position (in.) | Position (mm) | Area (mm^2) |
| 0.00 | 0.00 | 4162 |
| 0.25 | 6.35 | 4114 |
| 0.50 | 12.70 | 4045 |
| 0.75 | 19.05 | 3974 |
| 1.00 | 25.40 | 3895 |
| 1.25 | 31.75 | 3806 |
| 1.50 | 38.10 | 3708 |
| 1.75 | 44.45 | 3598 |
| 2.00 | 50.80 | 3242 |

TABLE 2

| Vertical | | |
|---|---|---|
| Position (in.) | Position (mm) | Incremental volume (mm^3) |
| −2.00 | −50.80 | 7 |
| −1.75 | −44.45 | 1,116 |
| −1.50 | −38.10 | 7,708 |
| −1.25 | −31.75 | 14,824 |
| −1.00 | −25.40 | 20,979 |
| −0.75 | −19.05 | 25,562 |
| −0.50 | −12.70 | 28,405 |
| −0.25 | −6.35 | 30,085 |
| 0.00 | 0.00 | 30,822 |

These results indicate that while the maximum side width Ws increases gradually from the top of the product fill to the bottom, the maximum horizontal slice cross-sectional area of a representative food load is located at or near the gusset depth. The data in Table 1 (shown graphically in FIG. 15A) also show that the cross-sectional area of the top slice is roughly 75% that of the maximum area slice and the transition from the maximum area slice to the bottom of the fill is more extreme than from that slice to the top of the fill, even though the side width Ws of the fill at the vertical centerline of front and back panels tapers gradually from the top to the bottom of the fill.

The vertical slice data show a gradual, but nonlinear decrease in the volume of the slices as one moves from the vertical centerline of the front and back panels to the inside edges of side seams.

The perspective drawing of the solid in FIG. 14A coupled with this data demonstrate the extreme changes in product fill dimensions and shape horizontally and vertically that are present in this type of package, and the significant changes in the food cross-sectional area and volume that must be taken into account to evenly heat a food product in such a pouch using a microwave oven.

EXAMPLE 2

The heating characteristics of a highly viscous food item in a stand up pouch were measured. The pouch had a length of about 225 mm, a width of about 165 mm, a gusset depth of about 42 mm, a side seam width of about 7 mm, and a center bottom gusset seal width of about 5 mm. The ratio of the pouch width W minus the two side seam widths to the gusset depth D was 1.80. The pouch also included a zipper about 38 mm from top edge of pouch. The total capacity of the pouch was about 1065 $cm^3$ to the bottom of the sealed zipper.

One (680.4 g) can of commercially available Dinty Moore Hearty Meals Beef Stew was placed into the pouch and the top was pinched closed to simulate top sealing. The resulting top of the food surface was about 101.6 mm from the bottom edge of pouch. The greatest center of panel to center of panel dimension was about 77.2 mm, located approximately at the top of the gusset region. The smallest center of panel to center of panel dimension was about 58.4 mm, located at top of the food surface.

Seven fiber optic probes were used to measure the temperature at various positions within the pouch. The probes were taped to a piece of corrugated board about 17.3 mm apart to maintain the relative positions of each probe. The top of the pouch was again pinched closed to simulate top sealing with a small horizontal vent area to ensure representative food shape was maintained.

Two control pouches (no microwave energy interactive elements) were evaluated. In Test 2-1, the probes were placed at about 89 mm above bottom edge of pouch (to determine the temperature of the upper portion of the food). In Test 2-2, the probes were placed at about 38 mm above bottom edge of pouch (to determine the temperature of the food along the interface between the first and second package regions, i.e., along the upper portion of the gusset area). These were compared with the same pouch including a microwave energy interactive shield on the front and back panels of the pouch, similar to the package configuration shown in FIG. 2.

The food was heated for 5 minutes in a 1000 watt turntable Panasonic microwave oven. Temperatures were recorded at a preset interval of 5 seconds for each of the 7 probes. The target temperature for the food was 70° C. The results are indicated in Table 3.

TABLE 3

| Test | Package | Probe position above bottom edge | Heating time (min) | Temperature range (° C.) |
|---|---|---|---|---|
| 2-1 | Control | 89 mm | 3.5 | 94-100 |
| 2-2 | Control | 38 mm | 5 | 25-37 |
| 2-3 | 127 mm × 88.9 mm solid shield extending 70 mm above food surface on the front and back panels | 38 mm | 3.25 | 70-93 |

In Test 2-1, the upper portion of the food item heated very quickly and boiled, far exceeding the target temperature of 70° C. In Test 2-2, even after 5 minutes, the food along the gusset area did not reach the target temperature of about 70° C. and actually increased only marginally from starting room temperature of about 21° C. However, in Test 2-3, the use of the microwave energy shielding element on the front and back panels of the pouch moderated the heating of the first package region, so the second package region was able to achieve the target temperature in 3.25 min. Thus, while not wishing to be bound by theory, large shields appear to be very effective in providing bulk heating of the package sections having a greater side width while preventing overheating in other areas of the package. Shielding elements also appear to be highly effective for use with highly viscous foods.

EXAMPLE 3

The effect of using a smaller stand up pouch to heat a highly viscous food was evaluated. The pouch had a length of about 184 mm, a width of about 139 mm, a gusset depth of about 38 mm, a side seam width of about 10 mm, and a gusset bottom seal width of about 5 mm. The ratio of the pouch width W minus the two side seam widths to the gusset depth D was 1.57. The total capacity of the pouch was about 473 $cm^3$ when sealed with a top seam width of about 10 mm.

About 510 g of Dinty Moore Hearty Meals Beef Stew was placed into the pouch and the top was sealed and a small vent created just below the top seal. The control pouch (Test 3-1) included no microwave energy interactive elements. The experimental pouches (Tests 3-2 to 3-5) included a microwave energy interactive shield on the front and back panels of the pouch, similar to the package configuration shown in FIG. 2. The microwave energy shield extended about 10 mm above the surface of the food.

The food was heated for 3.5 minutes in a 1000 watt turntable Panasonic microwave oven. After heating, a single fiber optic probe was used to measure the temperature of the upper portion of the food (about 38 mm below the top surface) within the first heating region (R1) and the lower portion of the food within the second heating region (about 38 mm from the bottom of the pouch) (R2). Six (6) measurements were taken at each location and averaged. The target temperature for the food was 70° C. The results are presented in Table 4.

TABLE 4

| Test | Shield size (mm) | R1 (° C.) | R2 (° C.) | Δ R1 v. R2 (° C.) | Δ R1 v. control (° C.) | Δ R2 v. control (° C.) |
|---|---|---|---|---|---|---|
| 3-1 | None | 95.0 | 35.0 | 60 | N/A | N/A |
| 3-2 | 114.3 × 88.9 | 97.2 | 32.8 | 64.4 | 2.2 | −2.2 |
| 3-3 | 114.3 × 63.5 | 85.6 | 35.0 | 50.6 | −9.4 | 0 |
| 3-4 | 114.3 × 50.8 | 80.6 | 55.0 | 25.6 | −14.4 | 20.0 |
| 3-5 | 114.3 × 25.4 | 97.2 | 56.1 | 41.1 | 2.2 | 21.1 |

In Test 3-2, little effect was seen compared with the control in Test 3-1. While not wishing to be bound by theory, it is believed that the large shield with the same vertical dimension as that used in Test 2-3 may have behaved similar to having no shield. The use of this large vertical dimension solid metallic shield on the smaller pouch used in Example 3 likely did not function to create enough biasing of energy to the gusset area to cause more even heating. In Test 3-3, the temperature of the food was moderated near the upper portion of the food, but little effect was seen in the second heating region (i.e., gusset area). The use of a mid-size shield in Test 3-4 increased the temperature of the second heating region, and reduced the heating of the upper portion of the food, as desired. The use of the smallest shield of Test 3-5 increased the temperature of the second heating region, but had little effect in the upper portion of the food. Thus, for more dense, viscous foods, a mid-sized shield relative to package size might provide optimal results.

EXAMPLE 4

The effect of heating a less viscous food in a stand up pouch was evaluated. The pouch had a length of about 184 mm, a width of about 139 mm, a gusset depth of about 38 mm, a side seam width of about 10 mm, and a gusset bottom seal width of about 5 mm. The ratio of the pouch width W minus the two side seam widths to the gusset depth D was 1.57. The total capacity of the pouch was about 473 $cm^3$ when sealed with a top seam width of about 10 mm.

About 244 g of Campbell's Chicken Noodle Soup was placed into the pouch and the top was sealed and a small vent created just below the top seal. The top of the food surface was about 101.6 mm from the bottom edge of pouch. The greatest center of panel to center of panel dimension was about 63.5 mm, located approximately at the top of the gusset region. The smallest center-of-panel to center-of-panel dimension was about 47.2 mm, located at top of the food surface.

The control pouches (Tests 4-1 and 4-6) included no microwave energy interactive elements. The experimental pouches (Tests 4-2 to 4-5 and Tests 4-7 to 4-10) included a microwave energy interactive shield on the front and back panels of the pouch, similar to the package configuration shown in FIG. 2. The microwave energy shield extended about 25.4 mm above the surface of the food, except in Tests 4-5 and 4-10, in which the microwave energy shield extended about 12.8 mm above the surface of the food.

The food was heated for 2.75 minutes (4-1 to 4-5) or 3.5 minutes (Tests 4-6 to 4-10) in a 1000 watt turntable Panasonic microwave oven. A handheld fast response thermocouple thermometer and rigid probe was used to measure the temperature of the upper portion of the food (about 38 mm below the top surface) within the first heating region (R1) and the lower portion of the food within the second heating region (about 38 mm from the bottom of the pouch) (R2). Six (6) measurements were taken at each location and averaged. The target temperature for the food was 70° C. The results are presented in Table 5.

TABLE 5

| Test | Shield size (mm) | Time (min) | R1 (° C.) | R2 (° C.) | Δ R1 v. R2 (° C.) | Δ R1 v. control (° C.) | Δ R2 v. control (° C.) |
|---|---|---|---|---|---|---|---|
| 4-1 | No shield | 2.75 | 77 | 68 | 9 | N/A | N/A |
| 4-2 | 114.3 × 88.9 | 2.75 | 71 | 67 | 4 | −6 | −1 |
| 4-3 | 114.3 × 63.5 | 2.75 | 81 | 75 | 6 | 4 | 7 |
| 4-4 | 114.3 × 50.8 | 2.75 | 76 | 68 | 8 | −1 | 0 |
| 4-5 | 114.3 × 25.4 | 2.75 | 81 | 75 | 6 | 4 | 7 |
| 4-6 | No shield | 3.5 | 96 | 74 | 22 | N/A | N/A |
| 4-7 | 114.3 × 88.9 | 3.5 | 79 | 71 | 8 | −17 | −3 |
| 4-8 | 114.3 × 63.5 | 3.5 | 91 | 77 | 14 | −5 | 3 |
| 4-9 | 114.3 × 50.8 | 3.5 | 97 | 76 | 21 | 1 | 2 |
| 4-10 | 114.3 × 25.4 | 3.5 | 93 | 74 | 19 | −3 | 0 |

In Tests 4-2 and 4-7, the use of the largest shield reduced heating of the upper portion of the food item more than in the gusset region, creating a greater than 50% reduction in the difference between the temperatures of the upper and gusset regions. In Test 4-5 and 4-8, the use of a smaller shield boosted the temperature along the upper portion of the food and in the gusset region, possibly by redistributing electromagnetic field modes in a beneficial manner. Thus, for highly fluid foods with composite densities approaching that of water, and capable of meaningful natural convection heat transfer flows, larger shields may reduce temperature differences more than smaller shields. Further, for shorter heating times, a broader range of shield sizes may provide some benefit compared to sizes showing benefits at longer heat times.

EXAMPLE 5

The effect of using different microwave energy interactive elements to heat food in a stand up pouch was evaluated. The pouch had a length of about 184 mm, a width of about 139 mm, a gusset depth of about 38 mm, a side seam width of about 10 mm, and a gusset bottom seal width of about 5 mm. The ratio of the pouch width W minus the two side seam widths to the gusset depth D was 1.57. The total capacity of the pouch was about 473 $cm^3$ when sealed with a top seam width of about 10 mm.

About 510 g of Dinty Moore Hearty Meals Beef Stew was placed into the pouch and the top was sealed and a small vent created just below the top seal. The control pouch (Test 5-1) included no microwave energy interactive elements. The experimental pouch of Test 5-2 included an about 114.3 mm×88.9 mm array of microwave energy reflective elements on the front and back panels of the pouch, similar to the package configuration shown in FIG. 3. The experimental pouch of Test 5-3 included both an array of microwave energy reflective elements and a microwave energy shielding patch on the front and back panels of the pouch, similar to the package configuration shown in FIG. 4. The experimental pouch of Test 5-4 included a substantially circular microwave energy shielding patch on the front and back panels of the pouch, similar to the package configuration shown in FIG. 7. The experimental pouch of Test 5-5 included a microwave energy directing element on the front and back panels of the pouch, similar to the package configuration shown in FIG. 9. The experimental pouch of Test 5-5 included a dual susceptor patch on the front and back panels of the pouch, similar to the package configuration shown in FIG. 11.

The food was heated for 2.75 minutes in a 1000 watt turntable Panasonic microwave oven. Eight fiber optic probes were used to measure the temperature at various positions within the pouch. Three probes were positioned near the bottom of the pouch within the gusset region. Two probes were positioned along the top of the gusset region. Three probes were positioned along the upper portion of the food item. The target temperature for the food was 70° C. The results are presented in Table 6.

In Test 5-3, a combination of a shielding patch and a reflective array was very effective in moderating top and top gusset temperatures while boosting bottom temperatures, reducing temperature differences between these areas as well as the overall range of individual measured temperatures to less than one half the differences and range in the control Test 5-1.

In Test 5-4, the circular shielding patch provided some impedance matching effects, increasing uniformity in bottom (gusset) area, which typically sees the greatest in-region variation.

In Test 5-5, the distributing element reduced temperature differences in the bottom region by about 66% and more modestly in the top and top of gusset regions.

In Test 5-6, the dual susceptor patch acted similarly to the reflective array of Test 5-2, reducing temperature differences between the bottom and the top of gusset and top areas. Similar comments regarding reducing cook end point time sensitivity are valid for this test as well.

The reflective arrays used singly in Test 5-2 and with a shield patch in Test 5-3 provide a tent or "awning" effect over top region, particularly the top surface and can be used from the top of the product fill to the top of the pouch headspace with reduced interaction between elements in opposing panels.

Microwave interactive elements not previously used effectively and robustly in flexible, pliable and deformable packages either singly or in combination have been shown to be surprisingly effective in reducing intra- and inter-region temperature differences in pouches having unusually complex food geometry. Many other arrangements and combinations are possible, now that this previously unanticipated application has been demonstrated to be effective and robust.

TABLE 6

| | Fill, | Microwave | Bottom of gusset (° C.) | | Top of gusset (° C.) | | Top portion of food (° C.) | | Top portion of food - bottom of gusset (° C.) | | Top of gusset - bottom of gusset (° C.) | | All (° C.) |
|---|---|---|---|---|---|---|---|---|---|---|---|---|---|
| Test | oz | interactive element | Range | Ave | Range | Ave | Range | Ave | Δ | Range | Δ | Range | Range |
| 5-1 | 11 | None | 31 | 55 | 8 | 90 | 2 | 91 | 36 | 55 | 35 | 57 | 57 |
| 5-2 | 11 | Reflective array | 20 | 47 | 2 | 75 | 21 | 80 | 33 | 53 | 28 | 41 | 53 |
| 5-3 | 11 | Reflective array plus shielding patch | 14 | 66 | 17 | 78 | 4 | 81 | 16 | 24 | 12 | 27 | 27 |
| 5-4 | 12 | Circular shielding patch | 20 | 55 | 15 | 74 | 5 | 83 | 28 | 39 | 19 | 35 | 39 |
| 5-5 | 12 | Distributing element | 11 | 46 | 13 | 85 | 6 | 86 | 40 | 51 | 39 | 52 | 52 |
| 5-6 | 12 | Dual susceptor patch | 30 | 46 | 15 | 68 | 5 | 82 | 36 | 50 | 22 | 41 | 50 |

In Test 5-2, the large coverage reflective array reduced heating in all regions, reducing temperature differences between the bottom and the top of gusset and top areas. The reduction of heating coupled with reduction in temperature differences may be useful for making the cook end point less sensitive to a narrow range of time, with a small tradeoff of increasing time to reach desired temperature modestly. Consumers often have difficulty with heating products that heat so rapidly that the optimum cook end point is within a very narrow time range, and results in either dramatic under- or over-cooking. As is known by those of skill in the art, effective applied power of consumer ovens varies substantially based on design, age and condition. Packages that deliver desired heating characteristics in a wide variety of ovens through minimizing end point time sensitivity may create more satisfying experiences for consumers, which can translate into increased sales for the food companies using such packages.

While the present invention is described herein in detail in relation to specific aspects and embodiments, it is to be understood that this detailed description is only illustrative and exemplary of the present invention and is made merely for purposes of providing a full and enabling disclosure of the present invention and to set forth the best mode of practicing the invention known to the inventor at the time the invention was made. The detailed description set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A package for use with microwave heating, the package comprising:

a first panel, a second panel, and a third panel; at least a portion of each of the first panel, the second panel, and the third panel being formed from a barrier material that is substantially transparent to microwave energy;

the first panel and the second panel being joined in a facing relationship and being joined together along upper edges and side edges;

the third panel being joined to the first panel and the second panel along lower edges of the first panel and the second panel; and the first panel, the second panel, and the third panel together defining an interior space having a lower region proximate the third panel and an upper region distal from the third panel, wherein the first panel and the second panel each include a microwave energy interactive area that is spaced from the third panel, the microwave energy interactive area being formed of a second material that is adapted to reflect substantially all microwave energy.

2. The package of claim 1, wherein the second material comprises a high optical density evaporated metallic element having a thickness of about 300 angstroms to about 700 angstroms.

3. The package of claim 1, wherein the second material comprises a metallic foil element having a thickness of about 5 micrometers to about 10 micrometers.

4. The package of claim 3, wherein the microwave energy interactive area of at least one of the first panel and the second panel further comprises an array of spaced apart metallic foil elements.

5. The package of claim 1, wherein the first panel and the second panel each include a second microwave energy interactive area positioned between the third panel and the microwave energy interactive area, the second microwave energy interactive area being formed of a third material that is adapted to absorb and convert at least a portion of the microwave energy to thermal energy.

6. The package of claim 1, wherein the third panel further comprises a gusset panel including:

a pair of gusset apexes having a gusset depth as measured from the gusset apexes to the lower edges of the first panel and the second panel, and a gusset center side width between the first panel and second panel at a midpoint between the gusset apexes, wherein the gusset depth is greater than the gusset center side width.

7. The package of claim 6, wherein the gusset panel has an arcuate shape.

8. The package of claim 6, wherein the gusset apexes define a boundary between the lower region and the upper region of the interior space, with the upper region between the gusset apexes and the upper edges of the first panel and the second panel comprising about 70% to about 90% of a length of the package.

9. The package of claim 1, wherein at least a portion of one of the first panel and the second panel is optically translucent or optically transparent.

10. A package for use with microwave heating, the package comprising:

a first panel, a second panel, and a third panel; at least a portion of each of the first panel, the second panel, and the third panel being formed from a barrier material that is substantially transparent to microwave energy;

the first panel and the second panel being joined in a facing relationship and being joined together along upper edges and side edges;

the third panel being joined to the first panel and the second panel along lower edges of the first panel and the second panel;

the first panel and the second panel each including a microwave energy interactive area formed of a second material that is adapted to reflect substantially all microwave energy; and the first panel, the second panel, and the third panel together defining an interior space having a lower region proximate the third panel and an upper region distal from the third panel, wherein, with the package in an upright orientation, the third panel is disposed below the upper region and the microwave energy interactive areas are above and spaced from the third panel, and the microwave energy interactive areas are adjacent the upper region.

11. The package of claim 10, wherein the third panel further comprises a gusset panel including:

a pair of gusset apexes having a gusset depth as measured from the gusset apexes to the lower edges of the first panel and the second panel, and a gusset center side width between the first panel and second panel at a midpoint between the gusset apexes, wherein the gusset depth is greater than the gusset center side width.

12. The package of claim 11, wherein the gusset panel has a downwardly-arcuate shape.

13. The package of claim 11, wherein the gusset apexes define a boundary between the lower region and the upper region of the interior space, with the upper region between the gusset apexes and the upper edges of the first panel and the second panel comprising about 70% to about 90% of a length of the package.

14. The package of claim 13, wherein the first panel and the second panel each include a second microwave energy interactive area positioned below the gusset apexes, the second microwave energy interactive area being formed of a third material that is adapted to absorb and convert at least a portion of the microwave energy to thermal energy.

15. The package of claim 10, wherein the package is retortable.

16. The package of claim 10, wherein at least a portion of one of the first panel and the second panel is optically translucent or optically transparent.

17. The package of claim 10, in combination with food, further comprising:

a quantity of food contained within the interior space and occupying the lower region and at least a portion of the upper region of the interior space, a top surface of the food being located within the upper region of the interior space, and wherein the microwave energy interactive areas of the first panel and the second panel extend above and below the top surface of the food.

18. The combination of claim 17, wherein the interior space includes a void above the top surface of the food, the void having a height from the top surface of the food to an uppermost portion of the interior space, and the microwave energy interactive areas of the first panel and the second panel extend above the top surface of the food of about 20% to about 100% of the height of the void.

19. The combination of claim 17, wherein the microwave energy interactive areas of the first panel and the second panel extend above the top surface of the food to the uppermost portion of the interior space.

20. A package for microwave heating, the package comprising:

a first panel, a second panel, and a third panel; at least a portion of each of the first panel, the second panel, and the third panel being formed from a barrier material that is substantially transparent to microwave energy;

the first panel and the second panel being joined in a facing relationship and being joined together along upper edges and side edges;

the third panel being joined to the first panel and the second panel along lower edges of the first panel and the second panel;

the first panel, the second panel, and the third panel together defining an interior space that is contiguous with a lower region proximate the third panel and an upper region distal from the third panel, the third panel being disposed below the upper region with the package in an upright orientation; and food contained within the interior space, the food occupying the lower region and at least a portion of the upper region of the interior space, a top surface of the food being located within the upper region of the interior space, wherein the first panel and the second panel each include a microwave energy interactive area formed of a second material that is adapted to reflect substantially all microwave energy, the microwave energy interactive areas being spaced from the third panel and adjacent the upper region of the interior space, and wherein the microwave energy interactive areas of the first panel and the second panel extend above and below the level of the top surface of the food.

21. The combination of claim 20, wherein the microwave energy interactive areas of the first panel and the second panel extend above the level of the top surface of the food to the uppermost portion of the interior space.

22. The package of claim 20, wherein the interior space includes a void above the top surface of the food, the void having a height from the top surface of the food to an uppermost portion of the interior space, and the microwave energy interactive areas of the first panel and the second panel extend above the top surface of the food of about 20% to about 100% of the height of the void.

23. The package of claim 20, wherein the barrier material further comprises a plurality of film materials in a layered configuration having an outer layer and an inner layer, with the second material being embedded between the outer layer and the inner layer.

24. The package of claim 20, wherein the barrier material further comprises a plurality of film materials in a layered configuration with an outer layer and an inner layer, with the second material being disposed on an outer surface of the outer layer.

25. The package of claim 20, wherein the third panel further comprises a gusset panel including:

a pair of gusset apexes having a gusset depth as measured from the gusset apexes to the lower edges of the first panel and the second panel, and a gusset center side width between the first panel and second panel at a midpoint between the gusset apexes, wherein the gusset depth is greater than the gusset center side width.

26. The package of claim 25, wherein the gusset panel has an arcuate shape.

27. The package of claim 25, wherein the gusset apexes define a boundary between the lower region and the upper region of the interior space, and the first panel and the second panel each include a second microwave energy interactive area positioned below the gusset apexes, the second microwave energy interactive area being formed of a third material that is adapted to absorb and convert at least a portion of the microwave energy to thermal energy.

28. A package for use with microwave heating, the package comprising:

a first panel, a second panel, and a gusset panel; at least a portion of each of the first panel, the second panel, and the gusset panel being formed from a barrier material that is substantially transparent to microwave energy;

the first panel and the second panel being joined in a facing relationship and being joined together along upper edges and side edges;

the gusset panel being joined to the first panel and the second panel along lower edges of the first panel and the second panel, the gusset panel including a pair of gusset apexes having a gusset depth as measured from the gusset apexes to lower edges of the first panel and the second panel, and a gusset center side width between the first panel and second panel at a midpoint between the gusset apexes;

the first panel, the second panel, and the gusset panel together defining an interior space having a lower region proximate the gusset panel and an upper region distal from the gusset panel, the gusset panel being disposed below the upper region, wherein the gusset depth is greater than the gusset center side width, and wherein the first panel and the second panel each include a microwave energy interactive area that is spaced from the gusset panel, the microwave energy interactive area being formed of a second material that is adapted to reflect substantially all microwave energy.

29. The package of claim 28, wherein the second material comprises at least one metallic foil element having a thickness of about 5 micrometers to about 10 micrometers.

30. The package of claim 28, wherein the barrier material further comprises a plurality of film materials in a layered configuration with an outer layer and an inner layer, with the second material being embedded between the outer layer and the inner layer.

31. The package of claim 28, wherein the barrier material further comprises a plurality of film materials in a layered configuration with an outer layer and an inner layer, with the second material being disposed on top the outer layer.

32. The package of claim 28, wherein the gusset apexes define a boundary between the lower region and the upper region of the interior space, and the first panel and the second panel each include a second microwave energy interactive area positioned below the gusset apexes, the second microwave energy interactive area being formed of a third material that is adapted to absorb and convert at least a portion of the microwave energy to thermal energy.

* * * * *